United States Patent [19]

Kobayashi et al.

[11] Patent Number: 4,518,682

[45] **Date of Patent: * May 21, 1985**

[54] SILVER HALIDE PHOTOGRAPHIC LIGHT-SENSITIVE MATERIAL

[75] Inventors: Hidetoshi Kobayashi; Toshiro Takahashi; Shigeo Hirano; Takeshi Hirose; Keiichi Adachi, all of Kanagawa, Japan

[73] Assignee: Fuji Photo Film Co., Ltd., Kanagawa, Japan

[ * ] Notice: The portion of the term of this patent subsequent to Jun. 28, 2000 has been disclaimed.

[21] Appl. No.: 532,631

[22] Filed: Sep. 15, 1983

[30] Foreign Application Priority Data

Sep. 16, 1982 [JP] Japan ..... 57-161515

[51] Int. Cl.[3] ..... G03C 7/26

[52] U.S. Cl. ..... 430/543; 430/553; 430/555; 430/557; 430/558; 430/598; 430/955

[58] Field of Search ..... 430/226, 553, 555, 557, 430/558, 598, 955, 543

[56] References Cited

U.S. PATENT DOCUMENTS 3,850,638 11/1974 Willis et al. ..... 430/598
3,990,899 11/1976 Shiba et al. ..... 430/505
4,232,107 11/1980 Janssens ..... 430/598
4,358,525 11/1982 Mooberry et al. ..... 430/955
4,371,604 2/1983 Vande Sande et al. ..... 430/955
4,390,618 6/1983 Kobayashi et al. ..... 430/955

*Primary Examiner*—J. Travis Brown
*Attorney, Agent, or Firm*—Sughrue, Mion, Zinn, Macpeak, and Seas

[57] ABSTRACT

A silver halide photographic light-sensitive material is disclosed. The material has improved sensitivity and granularity as well as an increased gradient. Further, the material can be processed by rapid processing methods. The material is comprised of a support having positioned thereon a light-sensitive silver halide emulsion layer and a compound represented by the general formula (I):

A-B (I)

wherein A is residue of a compound capable of undergoing a coupling reaction with an oxidized primary amine developer, the residue being derived by eliminating a hydrogen atom from an active position of the compound. B is a group capable of being released through a coupling reaction to exert a fogging effect.

11 Claims, No Drawings

SILVER HALIDE PHOTOGRAPHIC LIGHT-SENSITIVE MATERIAL

FIELD OF THE INVENTION

The present invention relates to a silver halide photographic light-sensitive material containing a compound capable of releasing a fogging agent in an imagewise manner, and to a process for forming images using the same.

BACKGROUND OF THE INVENTION

It is well known that dye images can be obtained by exposing in an imagewise manner a silver halide light-sensitive material, followed by a color development during which the reaction between an oxidized aromatic primary amine developer and a color-forming coupler takes place. In such a process, the subtractive color process is usually utilized for color reproduction, and cyan, magenta and yellow color images, which are complementary to red, green and blue colors, respectively, are formed. The reaction between a coupler and an oxidation product of a color developing agent proceeds at an active center of a coupler. A coupler having a hydrogen atom at its active center (i.e., 4-equivalent coupler) stoichiometrically requires as an oxidizing agent 4 moles of developable silver halide for forming 1 mole of dye through the coupling reaction. On the contrary, a coupler (or 2-equivalent coupler) having at its active center a group capable of being released in the form of an anion requires only 2 moles of developable silver halide for forming 1 mole of dye. Accordingly, by using a 2-equivalent coupler, the amount of silver halide to be used in a light-sensitive layer can be reduced and the layer per se can be made thinner, so that the time required for the processing of such a light-sensitive material can be shortened and dye images obtained therefrom can have an improved sharpness, compared with a light-sensitive material in which a 4-equivalent coupler is used. In addition, the coupling activity of a 2-equivalent coupler can be widely varied, depending on the property of the releasable group contained therein.

2-Equivalent couplers capable of releasing a group having a development-inhibiting effect are known and called development inhibitor releasing coupler (or DIR coupler). Such couplers are capable of inhibiting development in proportion to the quantity of developed silver and, therefore, can be effective for improving fineness, gradient and color reproducibility of the image. Couplers of this type can also be used in diffusion transfer processes, wherein their effects upon adjoining layers are utilized.

2-Equivalent couplers can also be provided with a releasable group containing a diffusible dye moiety. This class of couplers, which are referred to as diffusible dye-releasing coupler, can be utilized in a diffusion transfer process in which a dye image is formed from diffused dyes.

Certain colored 2-equivalent couplers can also be used to attain a masking effect necessary for color correction of dye images.

As mentioned hereinabove, 2-equivalent couplers can be provided with various functions, depending on the selection of releasable groups contained therein.

It is, therefore, an object of the present invention to provide a novel class of coupler with a new function.

On the other hand, regarding the recent trend in the development of silver halide light-sensitive materials, in particular, used for photographing, two major streams can be seen. One is the improvement in sensitivity, as typically shown by ASA 400 films, etc. The other is the improvement in image quality to cope with the miniaturization of film sizes. In connection with the former, investigations have been made on a variety of techniques, including, e.g., large size silver halide grains, couplers with higher activities, accelerated development, etc. However, the increase in sensitivity based on large size silver halide grains seems to be reaching its limit, as reported by G. C. Farnell and J. B. Chanter in *J. Photogr. Sci.*, 9, 73 (1961). Accordingly, this technique is not expected to make much contribution in the future. In addition, the use of large size silver halide grains is accompanied by various disadvantages, such as deterioration in granularity. Couplers having higher sensitivities have also been studied extensively. Such couplers, however, have not made much contribution to sensitivities of silver halide light-sensitive materials, and proved to be disadvantageous for granularity. With regard to acceleration of development, various development accelerators, including hydrazine compounds, have hitherto been attempted in silver halide emulsion layers (mainly of black-and-white light-sensitive materials) or developing solutions therefor. However, in most cases, the incorporation of developing accelerators into emulsion layers or developing solutions is accompanied by such disadvantages as increase in fog and deterioration in granularity, and hence impractical.

SUMMARY OF THE INVENTION

It is, therefore, an object of the present invention to provide a silver halide light-sensitive material having improved sensitivity and granularity.

It is another object of the present invention to provide a silver halide light-sensitive material having an increased gradient.

It is a further object of the present invention to provide a silver halide light-sensitive material capable of being processed by a rapid processing.

It has now been found that the above objects of the present invention can be achieved by incorporating a novel class of coupler capable of releasing a fogging agent or foggant (hereinafter referred to as foggant releasing coupler or FR coupler) into a silver halide light-sensitive material, so that the foggant can be released from the coupler in an imagewise manner during the course of development, thereby generating fog nuclei in undeveloped silver halide grains lying in the vicinity of a silver halide grain which is being developed and, hence, rendering the fogged silver halide grains developable.

Accordingly, in accordance with the present invention there is provided a silver halide light-sensitive material comprising at least one layer containing a compound represented by the following general formula (I):

$$A—B \qquad (I)$$

wherein A represents a residue of a compound capable of undergoing a coupling reaction with an oxidized primary amine developer, the residue being derived by eliminating a hydrogen atom from the active position of said compound; and B represents a group capable of being released through the coupling reaction to exert fogging effect.

DETAILED DESCRIPTION OF THE INVENTION

Couplers that release development accelerators are known and disclosed in U.S. Pat. Nos. 3,214,377 and 3,253,924 (incorporated herein by reference to disclose such couplers) and Japanese Patent Application (OPI) No. 17437/76. The known couplers release thiocyanate ions and are designed to accelerate development through solution physical development effect thereof. However, since conventional emulsions are mostly of the internal image type, the development acceleration effect exerted by thiocyanate ions is based on enlargement of respective spots at which the development of silver halide grains start (or development initiation spots), rather than increase in the number of development initiation spots. The use of this type of coupler is, therefore, inevitably accompanied by deterioration in granularity.

On the contrary, the acceleration of development attained by the use of couplers according to the present invention is based on increase in the number of development initiation spots which may be attributed to reductive fogging effect of released fogging agents capable of injecting electrons into silver halide grains, or of released fogging agents containing sulfur atoms and, hence, capable of generating developable sulfite specks in silver halide grains. That is, the couplers according to the invention exert their development acceleration effect through a mechanism different from the solution physical development described above. Furthermore, the development acceleration effect exerted by the couplers according to the present invention is markedly superior to that attained by the known thiocyanate-releasing couplers.

In the development of conventional silver halide light-sensitive materials, only silver halide grains having latent images therein can be substantially developed, and unexposed silver halide grains remain undeveloped. On the contrary, in the development of silver halide light-sensitive materials of the present invention, fogging agents released from a development initiation spot diffuse to neighboring undeveloped silver halide grains at which they generate fog nuclei. In other words, a plurality of fog nuclei can be generated and, therefore, a plurality of silver halide grains can be rendered developable by a single development initiation spot.

In the present invention, the release of fogging agent is effected in an imagewise manner. More specifically, the fogging agents are released in large quantities in high exposure areas, whereas they are released in small quantities in fog areas, so that greater development acceleration effect can be exerted at high exposure areas. In addition to this, silver halide grains exposed to light to such an extent that would hardly be developed by conventional development processes can also be developed in accordance with the present invention. The use of couplers according to the present invention, therefore, makes it possible to obtain increased sensitivity and gradient, as well as to accelerate development. These effects can be achieved without serious deterioration in granularity because of the increase in the number of development initiation spots.

A fogging agent (which is sometimes referred to as nucleating agent) is a compound capable of generating fog nuclei in undeveloped silver halide grains having no developing nuclei through injection of electrons, i.e., formation of silver sulfite specks, so as to render the grains developable. Examples of known fogging agents include hydrazines, such as those described, for example, in U.S. Pat. Nos. 2,417,975, 2,588,982, 2,618,656, 3,227,552, 3,761,276, 4,030,925, 4,031,127 and 4,080,207 and Japanese Patent Application (OPI) Nos. 74729/79, 133126/79 and 74536/80 (the term "OPI" as used herein refers to a "published unexamined Japanese patent application"); quaternary salts, such as those described, for example, in U.S. Pat. Nos. 3,615,615, 3,759,901, 3,719,474 and 3,761,276 and Japanese Patent Application (OPI) Nos. 3426/77, 69613/77 and 33120/80; thioureas, such as those described, for example, in *Research Disclosure,* No. 15750 (1977); and the like.

Detailed descriptions will hereinafter be given on FR couplers according to the present invention.

In the general formula (I):

$$A—B \qquad (I)$$

group A may be a residue derived from a cyan, magenta, yellow or non-color-forming coupler. Examples of preferable coupler residues represented by group A include residues of cyan color-forming couplers, such as phenols and naphthols; residues of magenta color-forming couplers, such as 5-pyrazolones, pyrazolobenzimidazoles, cyanoacetylcoumarones, open chain acylacetonitriles and indazolones; residues of yellow color-forming couplers, such as acylacetamides (e.g., benzoylacetanilide couplers, pivaloylacetanilide couplers, etc.), dibenzoylmethanes and malondianilides; and residues of non-color-forming couplers, such as open or cyclic chain active methylene compounds (e.g., indanones, cyclopentanones, diesters of malonic acid, imidazolinones, oxazolinones, thiazolinones, etc.).

In group B of the above-described general formula (I) there is contained a group capable, when released from the compound, of exerting fogging effect. Specific examples of groups capable of exerting fogging effect include residues of thiocarbonyls such as, typically, thioureas, thioamides, thiocarbamates, dithiocarbamates, rhodanines and thiohydantoins; and residues of compounds containing such functional groups or moieties as hydrazines, hydrazides, hydrazones, polyamines, enamines, acetylenes, quaternary salts and aldehydes.

The group B may also be a group capable of, after being released therefrom, undergoing an intermolecular nucleophilic displacement reaction, thereby eliminating a fogging agent, as is described in British Pat. No. 2,010,818 B; or a group provided with a timing function based on an electron transfer reaction via a conjugated system, and capable of releasing a fogging agent after the cleavage of the compound, as is described in British Pat. No. 2,072,363. The group B may additionally contain one or more appropriate substituents (e.g., an alkyl group and a group capable of being adsorbed by silver halides or silver) so as to adjust the diffusibility and fogging effect thereof.

Examples of cleavable groups which may be contained in group B include the followings:

$$-OCH_2-,\ -OCH_2CH_2-,\ -SCH_2-,\ -SCH_2CH_2-,$$

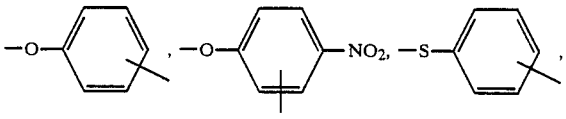

-continued

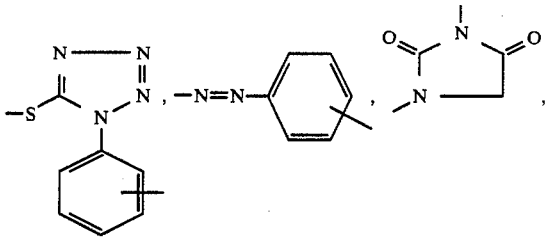

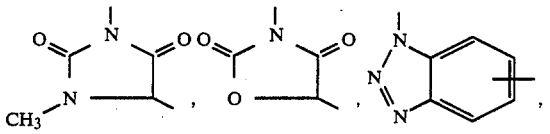

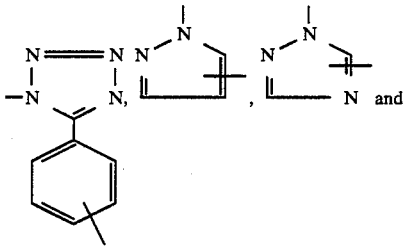

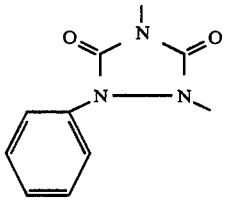

The group B may contain a linking group which links a cleavable group to a group capable of exerting fogging effect. Such a linking group may be selected from conventionally used divalent groups, including, e.g., alkylenes, alkenylenes, phenylenes, amines, $$-\overset{O}{\overset{\|}{C}}-,\quad -SO-,\quad -SO_2-,\quad -O-,\quad -S-,$$

$-N{=}N-$, or the like.

Examples of particularly useful groups represented by B include those containing a cleavable group, a linking group and a moiety capable of exerting fogging effect shown by the following general formula (II):

$$-X-\overset{S}{\overset{\|}{C}}-\overset{R_1}{\overset{|}{N}}- \qquad \text{(II)}$$

wherein $$-\overset{S}{\overset{\|}{C}}-$$

is a thiocarbonyl group; N is a nitrogen atom; $R_1$ is a hydrogen atom, an alkyl group, an aryl group or an acyl group; and X is an alkylene group, an alkenylene group, a phenylene group, —O—, —S—, or $$-\overset{R_1}{\overset{|}{N}}-$$

(wherein $R_1$ is as defined above); the group $$-X-\overset{S}{\overset{\|}{C}}-\overset{R_1}{\overset{|}{N}}-$$

together with other non-metallic atoms, may form a heterocyclic ring.

Specific examples of moieties shown by general formula (II) include the followings:

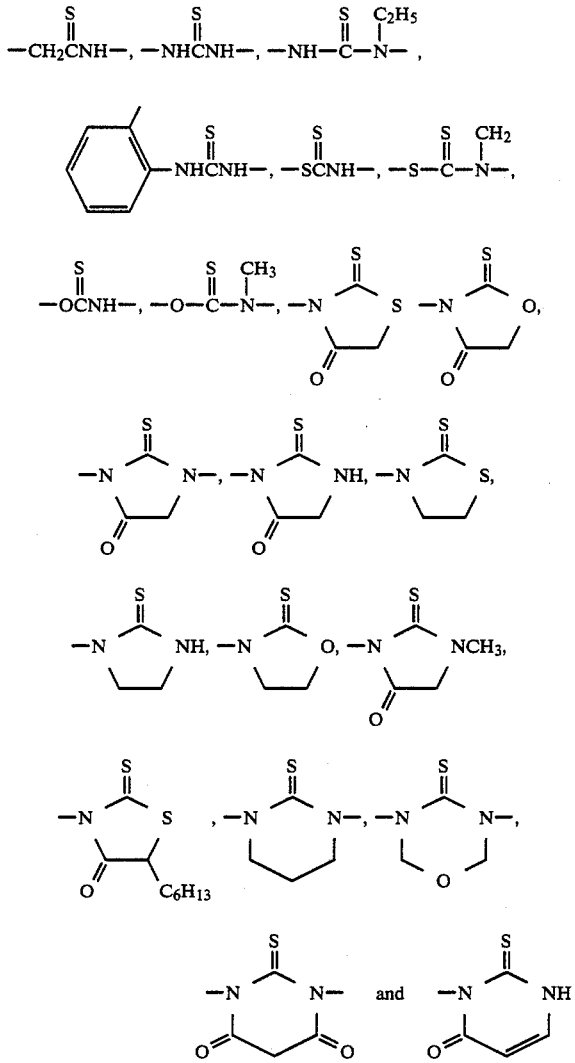

The moiety shown by general formula (II) is preferably linked to a cleavable group via a linking group at one end thereof and to a hydrogen atom or a group containing up to 22 carbon atoms (e.g., alkyl, aryl, acyl or a heterocyclic group) at the other end thereof.

Specific examples of group B include the followings:

$-OCH_2CH_2NHC(=S)NHCH_3$
$-OCH_2CH_2NHC(=S)N(C_2H_5)_2$
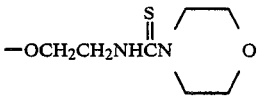
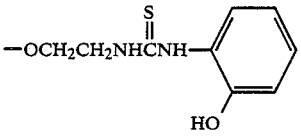
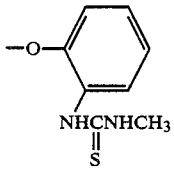
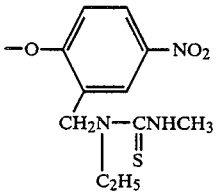
$-SCH_2CH_2NHC(=S)NHCH_3$
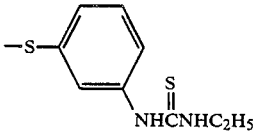
$-OCH_2CH_2NHC(=S)CH_3$
$-OCH_2CH_2NHC(=S)C_5H_{11}$
$-OCH_2CH_2NHC(=S)C_9H_{19}$
$-OCH_2CH_2C(=S)NH_2$
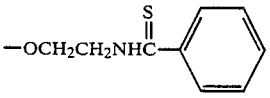
-continued
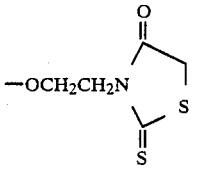
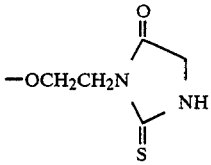
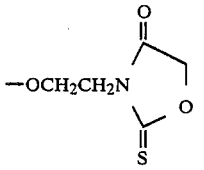
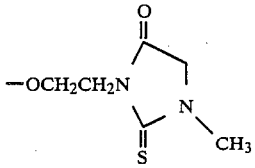
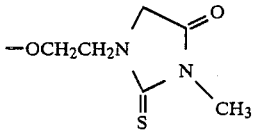
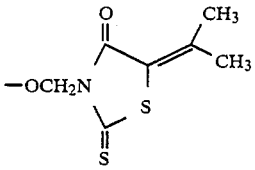
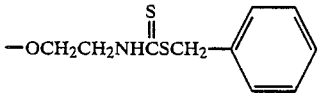
$-OCH_2CH_2NHC(=S)OC_2H_5$
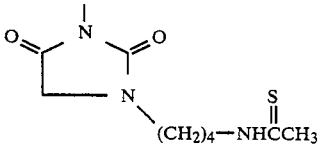
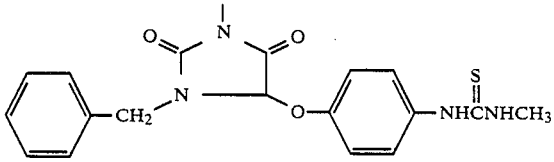

-continued

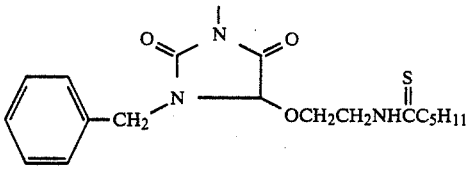

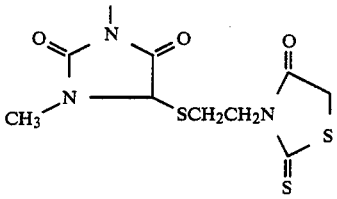

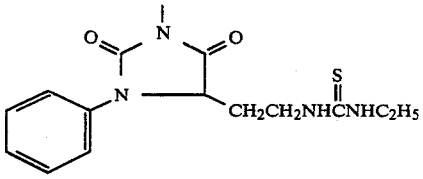

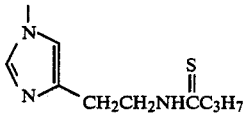

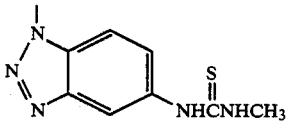

Examples of particularly useful coupler residues represented by A in the above-described general formula (I) include those represented by general formula (III), (IV), (V), (VI), (VII), (VIII), (IX), (X) or (XI) set forth below:

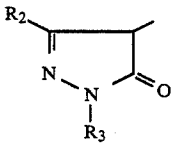

(III)

wherein $R_2$ represents an acylamino group, an anilino group or a ureido group; and $R_3$ represents a phenyl group which may be substituted with one or more halogen atoms, alkyl groups, alkoxy groups or cyano groups.

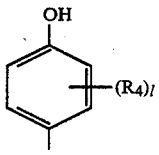

(IV)

wherein $R_4$ represents a halogen atom, an acylamino group or an aliphatic group; and l represents an integer of 1 to 4.

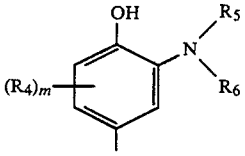

(V)

wherein $R_4$ is as defined above; $R_5$ and $R_6$ each represents an aliphatic group, an aromatic group or a heterocyclic group, either of $R_5$ and $R_6$ may be a hydrogen atom; and m represents an integer of 0 to 3.

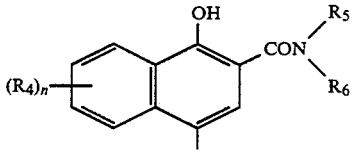

(VI)

wherein $R_4$, $R_5$ and $R_6$ are as defined above; and n represents an integer of 0 to 5.

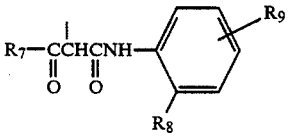

(VII)

wherein $R_7$ represents a tertiary alkyl group or an aromatic group; $R_8$ represents a hydrogen atom, a halogen atom or an alkoxy group; and $R_9$ represents an acylamino group, an aliphatic group, an alkoxycarbonyl group, a sulfamoyl group, a carbamoyl group, an alkoxy group, a halogen atom or a sulfonamido group.

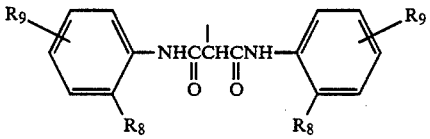

(VIII)

wherein $R_8$ and $R_9$ are as defined above.

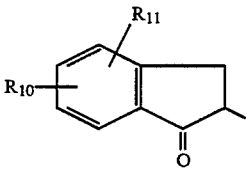

(IX)

wherein $R_{10}$ represents an aliphatic group, an alkoxy group, a mercapto group, an alkylthio group, an acylamido group, an alkoxycarbonyl group, a sulfonamido group, a carbamoyl group, a sulfamoyl group, an alkoxysulfonyl group, an aryloxysulfonyl group, an acyl group, a diacylamino group, an alkylsulfonyl group or an arylsulfonyl group; and $R_{11}$ represents a hydrogen atom, a halogen atom, an alkoxy group, an acyl group, a nitro group, an alkylsulfonyl group or an arylsulfonyl group; or the group represented by general formula (IX) above may be in the form of an enol ester thereof.

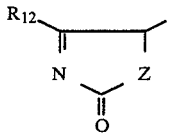

(X)

wherein $R_{12}$ represents an aliphatic group or an aromatic group; and Z represents an oxygen atom, a sulfur atom or a nitrogen atom.

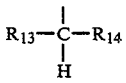

(XI)

wherein $R_{13}$ and $R_{14}$ each represents a group selected from those set forth below; or $R_{13}$ and $R_{14}$ in combination may form a 5- or 6-membered ring.

$R_{13}$ and $R_{14}$ are selected from the following:

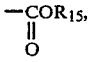

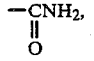

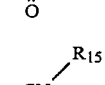

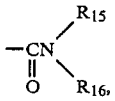

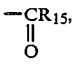

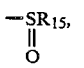

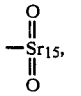

-continued

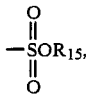

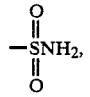

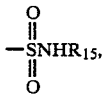

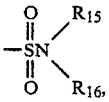

—CN,
—CHO,

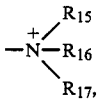

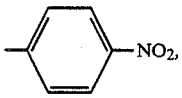

and

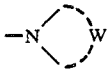

in which $R_{15}$, $R_{16}$ and $R_{17}$ each represents an aliphatic group, an aromatic group or a heterocyclic ring group; W represents a group of non-metal group necessary to form a 5- or 6-membered ring together with the nitrogen atom.

The following are specific examples of compounds of the present invention:

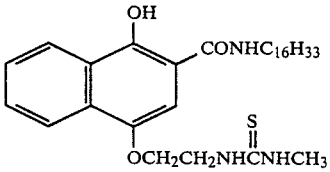

(1)

m.p. 110–112° C.

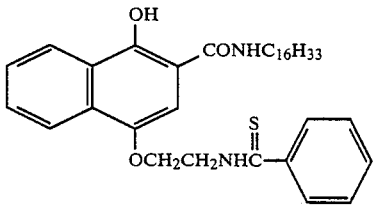

(2)

m.p. 88–89° C.

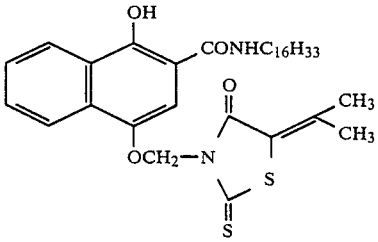

(3)

m.p. 61–63° C.

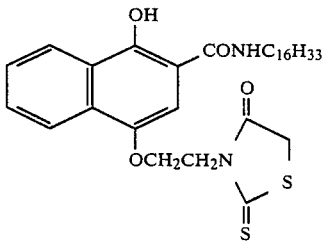

(4)

m.p. 124–126° C.

-continued
(5)
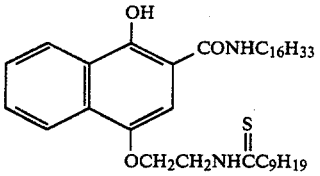
m.p. 64–65° C.
(6)
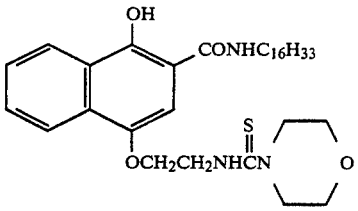
m.p. 106–109° C.
(7)
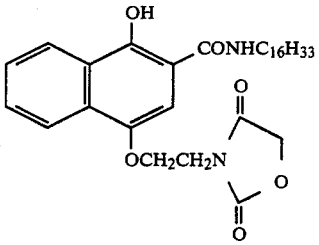
m.p. 110–112° C.
(8)
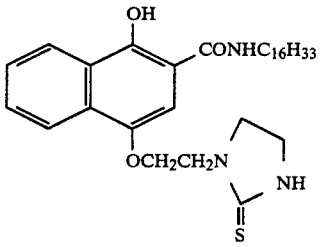
m.p. 148–150° C.
(9)
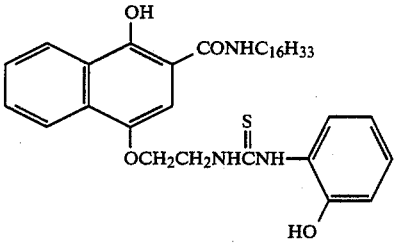
m.p. 119–121° C.
(10)
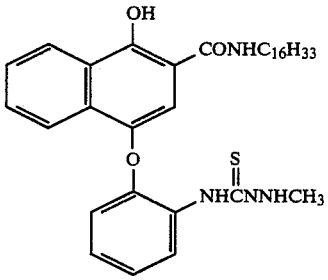
m.p. 122–125° C.
(11)
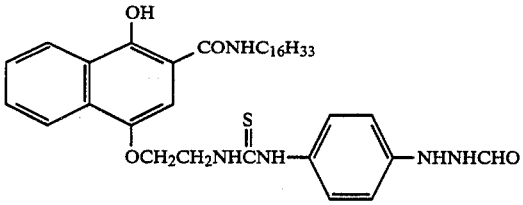
m.p. 143–146° C.
(12)
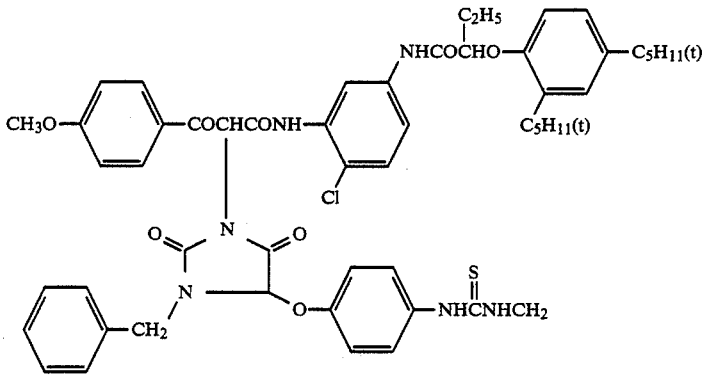
m.p. 124–127° C.

-continued (13)

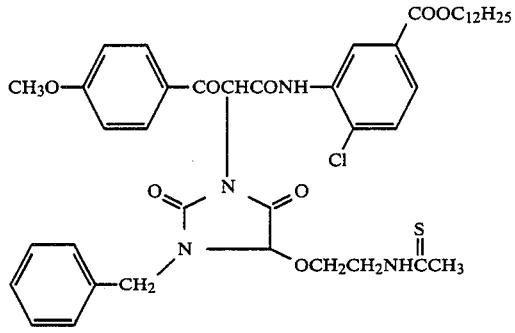

m.p. 68–69° C.

(14)

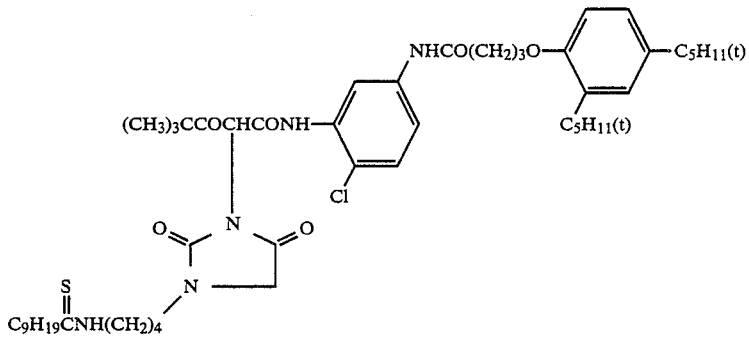

m.p. 71–73° C.

(15)

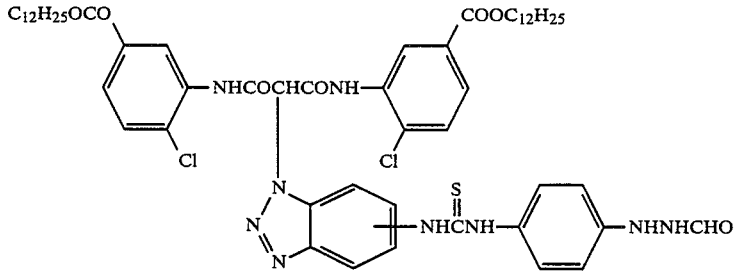

m.p. 113–115° C.

(16)

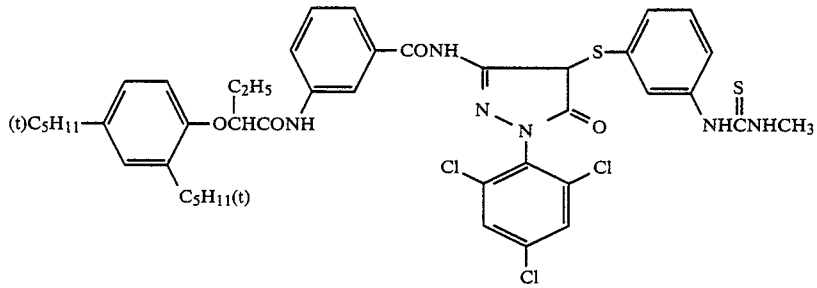

m.p. 84–86° C.

The compound of the present invention can be synthesized in accordance with various known methods. For example, thiocarbonyl compounds, including thioureas, thioamides, thiohydantoins, rhodanines, thiocarbamates and dithiocarbamates, can be synthesized by the methods described by S. R. Sandler and W. Karo, Organic Functional Group Preparation, Vol. 2, Academic Press (1971), Chapt. 6–7; R. N. Hurd and G. De LaMater, Chem. Rev., 61, 45 (1961); W. Walter and K. D. Bode, Angew. Chem., Int. Ed., 5, 447 (1966); W. Walter and J. Vossin in The Chemistry of Amides, edited by J. Zabicky, Wiley-Interscience (1970), p. 383; W. Walter and K. D. Bode, Angew. Chem., Int. Ed., 4, 281 (1967); and the like.

Typical synthesis routes are shown below:

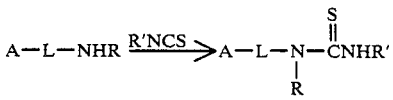

-continued

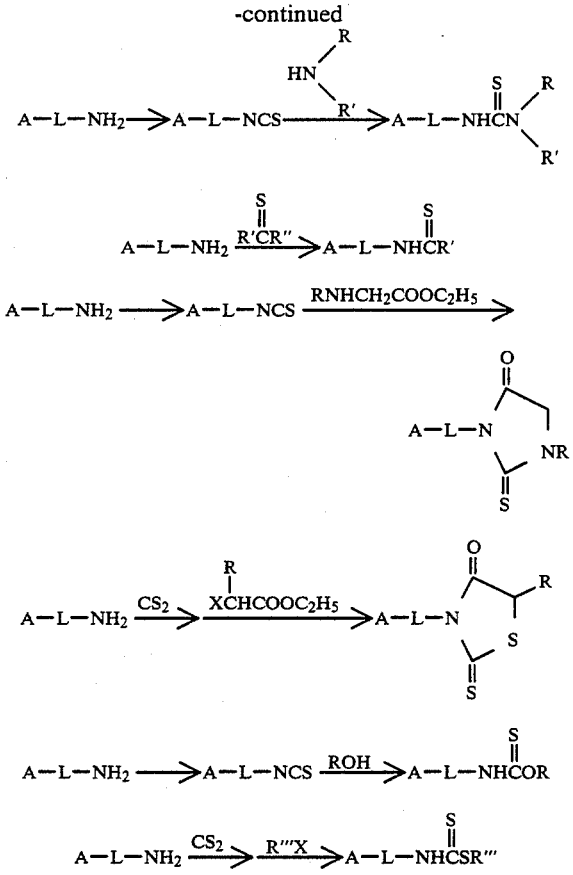

wherein:

A represents a coupler residue;

L represents a cleavable group;

R represents a hydrogen atom, an alkyl group or an aryl group;

R′ represents an alkyl group or an aryl group;

R″ represents —OR, —SR or —SH (where R is as defined above);

R‴ represents an alkyl group; and

X represents a halogen atom.

SYNTHESIS EXAMPLE 1

Preparation of Compound (1)

To a mixture of 128 g of 1,4-dihydroxy-2-hexadecylcarbamoylnaphthalene, 285 g of p-toluenesulfonic acid and 73 g of ethanolamine was added 300 ml of toluene. The resulting mixture was heated under reflux for about 2 hours under nitrogen atmosphere, during which water was removed by a water separator. Toluene was then evaporated off under reduced pressure and 1.5 l of water was added into the residue. Precipitated crystals were collected and recrystallized from ethyl acetate to give 99 g of 4-(2-aminoethyloxy)-2-hexadecylcarbamoyl-1-naphthol p-toluenesulfonate. Yield: 51%. M.P.: 140°-146° C.

Into 200 ml of chloroform were dissolved 23.5 g of 4-(2-aminoethyloxy)-2-hexadecylcarbamoyl-1-naphthol p-toluenesulfonate and 3.6 g of triethylamine, and then 3.2 g of methylthioisocyanate was added dropwise to the chloroform solution at room temperature. The resulting solution was stirred for an additional 2 hours and washed with water, and chloroform was evaporated under reduced pressure to give an oily residue. Compound (1) (18.3 g) was obtained by crystallizing the residue from methanol. Yield: 18.3 g. M.P.: 110°-112° C.

SYNTHESIS EXAMPLE 2

Preparation of Compound (2)

Into 10 ml of water was dissolved 0.4 g of sodium hydroxide, and 2.2 g of thiobenzoylthioglycolic acid was added thereto at room temperature. To this mixture were added in order 6.4 g of 4-(2-aminoethyloxy)-2-hexadecylcarbamoyl-1-naphthol, 0.4 g of sodium hydroxide and 50 ml of methanol. The reaction mixture was stirred for 30 minutes. Precipitated crystals were collected and recrystallized from a mixture of acetonitrile and methanol to give 4.3 of Compound (2).

Yield: 73%. M.P. 88°-89° C.

SYNTHESIS EXAMPLE 3

Preparation of Compound (4)

Into 100 ml of acetonitrile were dissolved under nitrogen atmosphere 12.9 g of 4-(2-aminoethyloxy)-2-hexadecylcarbamoyl-1-naphthol and 5.5 g of triethylamine, and the mixture was cooled with ice. To this ice-cooled mixture were added dropwise 2.3 g of carbon disulfide and 4.0 g of ethyl bromoacetate in this order. The temperature of the reaction mixture was gradually raised to room temperature. The mixture was stirred for 2 hours and 20 ml of water was added thereto. Precipitated crystals were collected and recrystallized from ethyl acetate to give 9.4 g of desired compound. Yield: 80%. M.P.: 124°-126° C.

SYNTHESIS EXAMPLE 4

Preparation of Compound (6)

Into 300 ml of methanol were dissolved 64 g of 4-(2-aminoethyloxy)-2-hexadecylcarbamoyl-1-naphthol and 35 g of triethylamine. To this mixture was added dropwise 19 g of carbon disulfide at a temperature not exceeding 10° C., and the resulting mixture was stirred for 1 hour. Thereafter, 11.9 g of ethyl chloroformate was added dropwise and stirred for additional 30 minutes. The resulting reaction mixture was poured into 1.5 l of water, and precipitated crystals were collected by filtration and recrystallization from acetonitrile to give 47 g of 4-(2-isothiocyanatoethyloxy)-2-hexadecylcarbamoyl-1-naphthol. Yield: 92%. M.P.: 90°-91° C.

Into 50 ml of chloroform was dispersed 5.1 g of 4-(2-isothiocyanotoethyloxy)-2-hexadecylcarbamoyl-1-naphthol. While stirring, 1.7 g of morpholine was added dropwise to the dispersion at room temperature. The resulting mixture was additionally stirred for 30 minutes. A uniform solution obtained was washed with water, and chloroform was evaporated under reduced pressure. Oily residue was recrystallized from methanol to give 5.2 g of Compound (6). Yield: 86%. M.P.: 106°-109° C.

SYNTHESIS EXAMPLE 5

Preparation of Compound (8)

To a mixture of 23.5 g of 4-(2-isothiocyanatoethyloxy)-2-hexadecylcarbamoyl-1-naphthol, 9.6 g of ethyl glycinate hydrochloride and 7 g of triethylamine were added 100 ml of methanol and 100 ml of ethyl acetate. The reaction mixture was stirred at room temperature for 2 hours, washed with water, and condensed under reduced pressure. Precipitated crystals were collected by filtration. 14 g of Compound (8) was obtained. Yield: 53%. M.P.: 148°–150° C.

SYNTHESIS EXAMPLE 6

Preparation of Compound (9)

Into 100 ml of chloroform were dissolved 5.1 g of 4-(2-isocyanatoethyloxy)-2-hexadecylcarbamoyl-1-naphthol and 4.4 g of o-aminophenol, and the resulting mixture was stirred under nitrogen atmosphere for 1.5 hours at a temperature of 60° C. Chloroform was evaporated under reduced pressure, and the residue was dissolved into ethyl acetate and washed with water. Ethyl acetate was evaporated under reduced pressure, and the residue was dissolved into acetonitrile, treated with active carbon, and crystallized to give 4.8 g of Compound (9). Yield: 77%. M.P.: 119°–121° C.

SYNTHESIS EXAMPLE 7

Preparation of Compound (10)

Into 50 ml of DnF were dissolved 12.8 g of 1,4-dioxy-2-hexadecylcarbamoylnaphthalene and 4.4 g of o-fluoronitrobenzene. An aqueous solution of 2.6 g of sodium hydroxide was added dropwise under nitrogen atmosphere at room temperature, and stirred for an additional 2 hours. Thereafter, 200 ml of water was added, and the resulting mixture was extracted with 50 ml of ethyl acetate. The extract was condensed under reduced pressure, and the oily residue was crystallized from a mixture of ethyl acetate and methanol to give 10 g of 2-hexadecylcarbamoyl-4-(2-nitrophenyl)-1-naphthol. Yield: 61%.

The thus obtained 2-hexadecylcarbamoyl-4-(2-nitrophenoxy)-1-naphthol (10 g) was reduced with iron in isopropanol. The reaction mixture was filtered, condensed under reduced pressure and added with concentrated hydrochloric acid, and precipitated crystals were collected by a filtration to give 5.8 g of 4-(2-aminophenoxy)-2-hexadecylcarbamoyl-1-naphthol hydroxide. Yield: 57%.

Into 50 ml of chloroform was dispersed 5.6 g of 4-(2-aminophenoxy)-2-hexadecylcarbamoyl-1-naphthol. While stirring, 1.1 g of triethylamine was added dropwise into the dispersion under nitrogen atmosphere at room temperature. Thereafter, 0.8 g of methyl isothiocyanate was added dropwise, and the resulting mixture was stirred for additional 2 hours and then washed with water. The solvent was evaporated under reduced pressure, and the residue was crystallized from methanol to give 4.9 g of Compound (10). Yield: 82%. M.P.: 122° to 125° C.

SYNTHESIS EXAMPLE 8

Preparation of Compound (11)

Into a mixture of 50 ml of methanol and 100 ml of ethyl acetate was dispersed 16 g of 4-(2-aminoethyloxy)-2-hexadecylcarbamoyl-1-naphthol. To this dispersion were added with stirring under nitrogen atmosphere 2.5 g of triethylamine and then 5.3 g of 4-(2-formylhydrazino)phenylisothiocyanate at a temperature of 50° C. The reaction mixture was stirred for an additional 1.5 hours and condensed under reduced pressure. The residue was purified by the use of a chromatographic column and recrystallized from acetone to give 5.7 g of Compound (11). Yield: 34%. M.P.: 143°–146° C.

SYNTHESIS EXAMPLE 9

Preparation of Compound (13)

Into 100 ml of chloroform were dissolved 10 g of 5-(2-aminoethyloxy)-1-benzylhydantoin and 4 g of triethylamine. While stirring, a solution of 11.9 g of α-bromo-α-(4-methoxybenzoyl)-2-chloro-5-dodecyloxycarbonylacetanilide in 50 ml of chloroform was added dropwise over a period of about 1 hour at room temperature. After being stirred for an additional 2 hours, the reaction mixture was condensed under reduced pressure, and the residue was purified by the use of a chromatographic column to give 14.1 g of α-(4-methoxybenzoyl)-α-[5-(2-aminoethyloxy)-1-benzyl-3-hydantoinyl]-2-chloro-5-dodecyloxycarbonylacetanilide. Yield. 92%. Oil.

Into 50 ml of chloroform were dissolved 7.6 g of α-(4-methoxybenzoyl)-α-[5-(2-aminoethyloxy)-1-benzyl-3-hydantoinyl]-2-chloro-5-dodecyloxycarbonylacetanilide and 1.1 g of triethylamine. Thereafter, with stirring at room temperature, 1.4 g of thioacetylthioglycolic acid was added, and the reaction was allowed to proceed for 30 minutes. The reaction mixture was washed with water, condensed, and recrystallized from methanol to give 6.9 g of Compound (13). Yield: 84%. M.P.: 68°–69° C.

| | | Elemental Analysis | | | |
|---|---|---|---|---|---|
| Compound | Formula | | H (%) | C (%) | N (%) |
| 1 | $C_{31}H_{49}N_3O_3S$ | Calcd. | 9.01 | 68.47 | 7.73 |
| | | Found | 9.08 | 68.24 | 7.64 |
| 2 | $C_{36}H_{50}N_2O_3S$ | Calcd. | 8.53 | 73.18 | 4.74 |
| | | Found | 8.48 | 73.34 | 4.82 |
| 3 | $C_{34}H_{48}N_2O_4S_2$ | Calcd. | 7.89 | 66.63 | 4.57 |
| | | Found | 7.86 | 66.52 | 4.54 |
| 4 | $C_{32}H_{46}N_2O_4S_2$ | Calcd. | 7.90 | 65.49 | 4.77 |
| | | Found | 7.76 | 65.44 | 4.73 |
| 5 | $C_{39}H_{64}N_2O_3S$ | Calcd. | 10.06 | 73.08 | 4.37 |
| | | Found | 9.98 | 73.16 | 4.41 |
| 6 | $C_{32}H_{53}N_3O_4S$ | Calcd. | 8.91 | 68.08 | 7.01 |
| | | Found | 8.79 | 68.21 | 7.03 |
| 7 | $C_{32}H_{46}N_2O_5S$ | Calcd. | 8.12 | 67.34 | 4.91 |
| | | Found | 8.10 | 67.26 | 4.74 |
| 8 | $C_{32}H_{47}N_3O_4S$ | Calcd. | 8.31 | 67.46 | 7.37 |
| | | Found | 8.24 | 67.53 | 7.32 |
| 9 | $C_{36}H_{51}N_3O_4S$ | Calcd. | 8.27 | 69.53 | 6.76 |
| | | Found | 8.12 | 69.41 | 6.82 |
| 10 | $C_{35}H_{49}N_3O_3S$ | Calcd. | 8.34 | 71.03 | 7.10 |
| | | Found | 8.48 | 70.96 | 6.99 |
| 11 | $C_{37}H_{53}N_5O_4S$ | Calcd. | 8.05 | 66.94 | 10.55 |
| | | Found | 8.11 | 66.72 | 10.41 |
| 12 | $C_{54}H_{61}N_6O_8SCl$ | Calcd. | 6.21 | 65.54 | 8.49 |
| | | Found | 6.34 | 65.48 | 8.54 |
| 13 | $C_{43}H_{53}N_4O_8SCl$ | Calcd. | 6.50 | 62.87 | 6.82 |
| | | Found | 6.54 | 62.76 | 6.80 |
| 14 | $C_{50}H_{76}N_5O_6SCl$ | Calcd. | 8.41 | 65.94 | 7.69 |
| | | Found | 8.34 | 65.78 | 7.72 |
| 15 | $C_{55}H_{71}N_9O_7SCl_2$ | Calcd. | 6.67 | 61.55 | 11.75 |
| | | Found | 6.71 | 61.45 | 11.78 |
| 16 | $C_{44}H_{49}N_6O_4S_2Cl_3$ | Calcd. | 5.51 | 58.96 | 9.38 |
| | | Found | 5.48 | 59.12 | 9.31 |

The compounds according to the present invention, whether used alone or in combination with another color-forming coupler, can undergo a coupling reaction with an oxidized developing agent, thereby releasing a diffusible compound which generates fogs in undeveloped silver halide grains to render them developable, or in silver halide grains which are being developed only slowly so as to accelerate the development thereof. As a result, the following effects could be attained. (i) Increased densities can be obtained with the same quantity of exposure, compared with the cases where conventional couplers are used; (ii) The increase in density can be relatively small in fog areas since the fogging agents can be released in smaller quantities in such areas; and (iii) Accelerated development speeds can be obtained.

On the basis of the above-described effects, higher gradients, as well as increased sensitivities can be attained simultaneously. The improvements in gradient can be evidence that the action of released fogging agents is exerted in an imagewise manner. The couplers according to the present invention can also be effective for the improvement in image qualities, in particular, granularity when used in combination with a low sensitive fine grain emulsion, or in combination with a less active coupler, as well as in combination with a development inhibitor or a precursor thereof.

The accelerated development speed attainable by the couplers according to the invention could also be advantageous for the shortening of processing time. It is well known that the development of underneath layers in multicolor light-sensitive materials tends to be more retarded than upper layers thereof because of the diffusion of development-inhibiting substances from upper layers and the delay in the penetration of developing solution thereinto. The couplers according to the present invention can exert marked development acceleration effects when used in underneath layers of such color light-sensitive materials.

Furthermore, the couplers according to the present invention can also be highly effective for the reduction in the number of so-called "dead grains", i.e., silver halide grains which would never be developed even when subjected to a development treatment for a prolonged period of time. Accordingly, the use of couplers according to the present invention makes it possible to reduce the amount of silver used, in particular, in color photographic materials in which large quantities of silver are ordinarily used.

The couplers according to the present invention can be used for any kind of silver halide color photographic materials, including, for example, color negative films, color papers, color positive films, color reversal films for slides, and color reversal films for motion picture and television. The couplers can be particularly effective for color negative or reversal films which are required to possess both high sensitivities and high image qualities.

With the recent steep rise in the price of silver, which is a raw material for photographic light-sensitive materials, reducing the amount of silver to be used has become very important, in particular, in the case of X-ray films which require the use of large quantities of silver. From this point of view, it has been proposed to make use of dyes in X-ray films, for example, through the incorporation of a black color-forming coupler (see, e.g., U.S. Pat. Nos. 3,622,629, 3,734,735 and 4,126,461 and Japanese Patent Application (OPI) Nos. 42725/77, 105247/80 and 105248/80) or of a combination of couplers that form three different colors (see, e.g., Research Disclosure, No. 17123). The couplers according to the present invention can be used with particular effectiveness in such X-ray films as they can contribute much for more effective use of silver and, at the same time, faster processing thereof.

The photographic emulsion layers of the photographic light-sensitive materials of the invention can be incorporated, in addition to the FR couplers according to the invention, with conventional color-forming couplers, i.e., compounds capable of forming color through coupling reactions with oxidized primary amine developing agents (e.g., phenylenediamines, aminophenol derivatives, etc.) during the course of color development processing. Examples of such couplers include magenta couplers, such as 5-pyrazolones, pyrazolobenzimidazoles, cyanoacetylcoumarones and open chain acylacetonitriles; yellow couplers, such as acylacetamides (e.g., benzoylacetanilides, pyvaloylacetanilides, etc.); and cyan couplers, such as naphthols and phenols. It is preferable to use couplers containing a hydrophobic group (so-called ballast group) within the molecule or polymeric non-diffusible couplers. They may be either 2-equivalent or 4-equivalent couplers. It is also possible to use couplers capable, upon development, of forming a dye having a suitable diffusibility, such as those described in British Patent No. 2,083,640A. Other examples of usable couplers include colored couplers capable of exerting color correction effects, couplers capable of releasing development inhibitors during the course of development (so-called DIR couplers), as well as non-color-forming DIR coupling compounds capable of releasing development inhibitors and forming colorless coupling products.

In addition to these couplers, the photographic light-sensitive materials of the present invention may be incorporated with non-color-forming couplers capable of forming colorless coupling products, infrared couplers capable of forming dyes which absorb infrared rays, black color-forming couplers capable of forming black dye images through coupling, or the like.

Specific examples of magenta color-forming couplers usable in the light-sensitive materials of the present invention include those described in U.S. Pat. Nos. 2,600,788, 2,983,608, 3,062,653, 3,127,267, 3,311,476, 3,419,391, 3,519,429, 3,558,319, 3,582,322, 3,615,506, 3,834,908, 3,891,445, 3,926,631, 3,928,044, 4,076,533, 4,189,321 and 4,220,470, German Pat. No. 1,810,464, German Patent Application (OLS) Nos. 2,408,665, 2,417,945, 2,418,959, 2,424,467, 2,536,191, 2,651,363, 2,935,848 and 2,944,601, Japanese Patent Publication Nos. 6031/65, 38498/79, 10901/80, 29420/80 and 29421/80, and Japanese Patent Application (OPI) Nos. 74027/74, 129538/74, 60233/75, 159336/75, 20826/76, 26541/76, 36938/76, 105820/76, 42121/77, 58922/77, 9122/78, 55122/78, 48540/79, 80744/79, 62454/80 and 118034/80.

As specific examples of yellow color-forming couplers which can be used in the present invention, mention may be made of those described in U.S. Pat. Nos. 2,875,057, 3,265,506, 3,408,194, 3,551,155, 3,582,322, 3,725,072, 3,891,445, 3,894,875, 3,973,968, 3,990,896, 4,008,086, 4,012,259, 4,022,620, 4,029,508, 4,046,575, 4,057,432, 4,059,447, 4,095,983, 4,133,958, 4,157,919, 4,182,630, 4,186,019, 4,203,768 and 4,206,278, German Patent No. 1,547,868, German Patent Application (OLS) Nos. 2,213,461, 2,219,917, 2,261,361, 2,263,875, 2,414,006, 2,528,638, 2,935,849 and 2,936,842, British Patent No. 1,425,020, Japanese Patent Publication Nos. 13576/74, 10783/76, 36856/79 and 13023/80, Japanese Patent Application (OPI) Nos. 26133/72, 66835/73, 6341/75, 34232/75, 87650/75, 130442/75, 75521/76, 102636/76, 145319/76, 21827/76, 82424/77, 115219/77, 48541/79, 121126/79, 2300/80, 36900/80, 38576/80 and 70841/80; and *Research Disclosure,* No. 18053.

Specific examples of cyan color-forming couplers which can be used in the present invention include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,758,308, 3,767,411, 4,004,929, 4,052,212, 4,124,396, 4,146,396 and 4,205,990, German Patent Application (OLS) Nos. 2,214,489, 2,414,830, 2,454,329, 2,634,694, 2,841,166, 2,934,769, 2,945,813, 2,947,707 and 3,005,355, Japanese Patent Publication Nos. 37822/79 and 37823/79, and Japanese Patent Application (OPI) Nos. 5055/73, 59838/73, 130441/75, 26034/76, 146828/76, 69824/77, 90932/77, 52423/78, 105226/78, 110530/78, 14736/79, 48237/79, 66129/79, 13193/79, 32071/80, 65957/80, 73050/80 and 108662/80.

Specific examples of usable colored couplers include those described in U.S. Pat. Nos. 2,521,908, 3,034,892 and 3,476,560, German Patent Application (OLS) No. 2,418,959, Japanese Patent Publication Nos. 22335/63, 11340/67, 2016/69 and 32461/69, and Japanese Patent Application (OPI) Nos. 26034/76 and 42121/77.

Specific examples of DIR couplers usable in the present invention include those described in U.S. Pat. Nos. 3,227,554, 3,617,291, 3,632,345, 3,701,783, 3,790,384, 3,933,500, 3,938,996, 4,052,213, 4,157,916, 4,171,223, 4,183,752, 4,187,110 and 4,226,934, German Patent Application (OLS) Nos. 2,414,006, 2,454,301, 2,454,329, 2,540,959, 2,707,489, 2,709,688, 2,730,824, 2,754,281, 2,835,073, 2,853,362, 2,855,697 and 2,902,681, British Pat. No. 953,454, Japanese Patent Publication Nos. 16141/76, 2776/78 and 34933/80, Japanese Patent Application (OPI) Nos. 122335/74, 60624/77, 154631/77, 7232/78, 9116/78, 15136/78, 20234/78, 29717/78, 13533/78, 143223/78, 73033/79, 114241/79, 115229/79, 145135/79, 84935/80 and 135835/80, and *Research Disclosure,* No. 18104. Other examples of usable development inhibitor-releasing couplers include those which release development inhibitors with the action of a timing group, as described in British Pat. Nos. 2,010,818B and 2,072,363A.

As described above, the photographic light-sensitive materials of the present invention can be incorporated with compounds capable of releasing development inhibitors during the course of development. Examples of such compounds include those described in U.S. Pat. Nos. 3,297,445 and 3,379,529, German Patent Application (OLS) No. 2,417,914, and Japanese Patent Application (OPI) No. 9116/78.

Specific examples of non-color-forming couplers which can be used in the present invention include those described in U.S. Pat. Nos. 3,912,513 and 4,204,867, and Japanese Patent Application (OPI) No. 152721/77.

Examples of usable infrared couplers include those described in U.S. Pat. No. 4,178,183, Japanese Patent Application (OPI) No. 129036/78 and *Research Disclosure,* Nos. 13460 and 18732.

Specific examples of usable black color-forming couplers include those described in U.S. Pat. Nos. 4,126,461, 4,137,080 and 4,200,466, and Japanese Patent Application (OPI) Nos. 46029/78, 133432/78, 105247/80 and 105248/80.

As already mentioned above, the emulsion layers of the photographic light-sensitive materials of the present invention can be incorporated with a polymeric coupler, in combination with the FR couplers according to the invention. Examples of usable polymeric couplers include those described in U.S. Pat. Nos. 2,698,797, 2,759,816, 2,852,381, 3,163,652, 3,208,977, 3,211,552, 3,299,013, 3,370,952, 3,424,583, 3,451,820, 3,515,557, 3,767,412, 3,912,513, 3,926,436, 4,080,211, 4,128,427 and 4,215,195, and *Research Disclosure,* Nos. 17825, 18815 and 19033.

The couplers according to the present invention can be used in an amount of from 0.001 to 100% by mole, preferably from 0.1 to 10% by mole, based on the total amount of couplers used. The total amount of couplers used can be in the range of from $2\times10^{-3}$ to $5\times10^{-1}$, preferably from $1\times10^{-2}$ to $5\times10^{-1}$, per mole of silver.

Specific examples of couplers which can be used in combination with the couplers according to the present invention are as follows:

Magenta Color-Forming Couplers

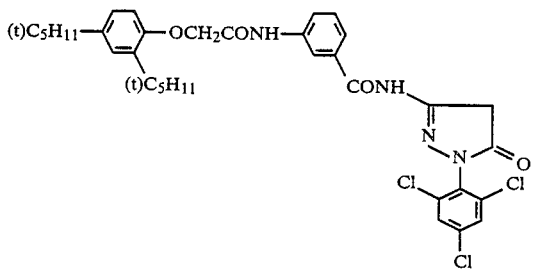

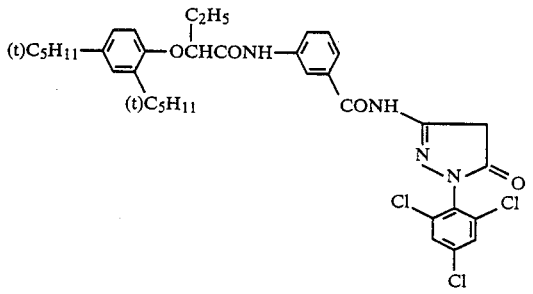

-continued
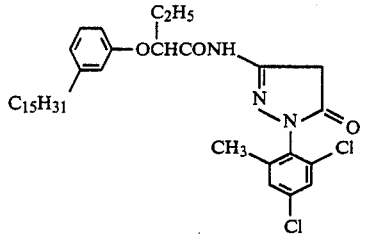
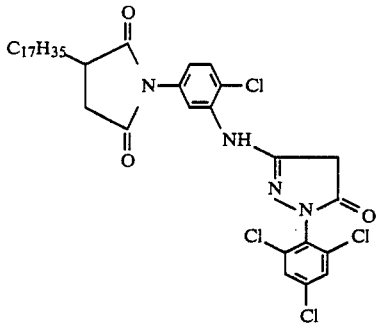
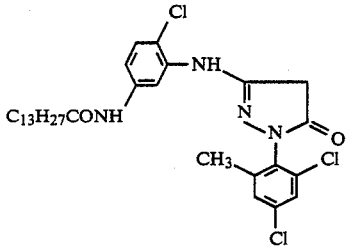
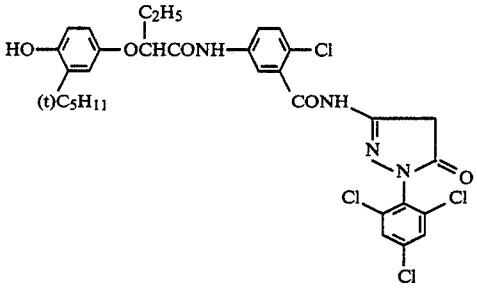
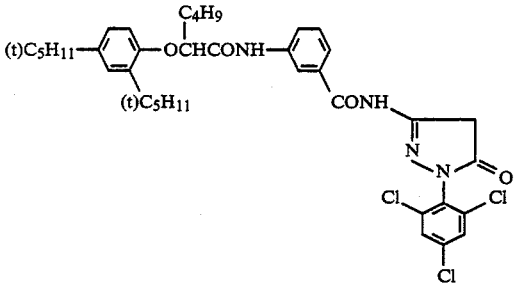
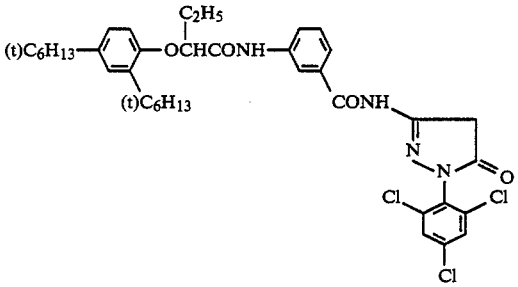
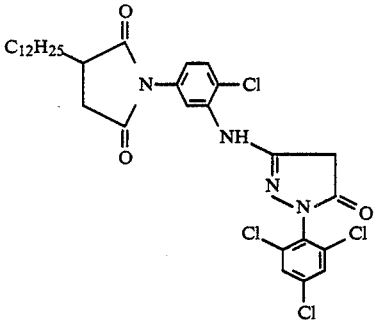
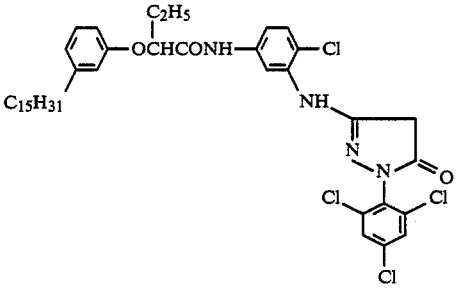

-continued
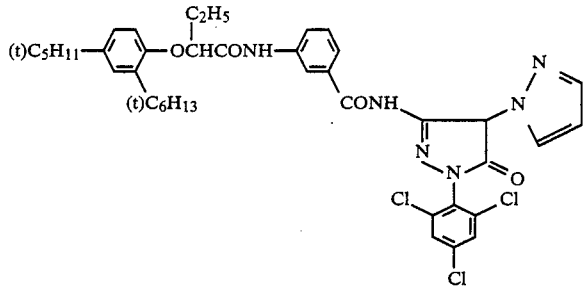
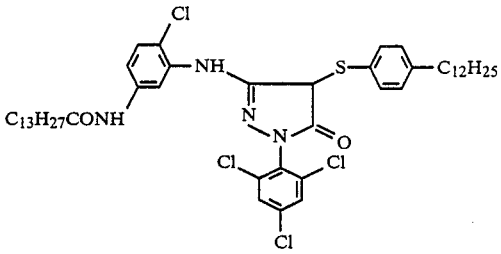
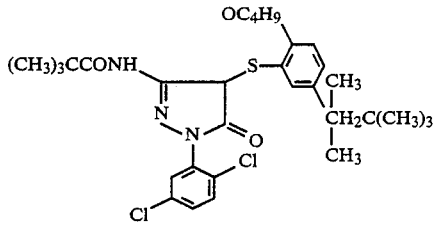
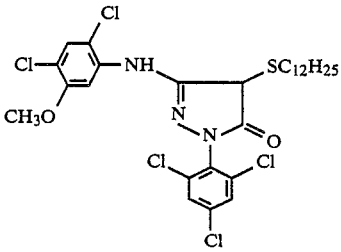
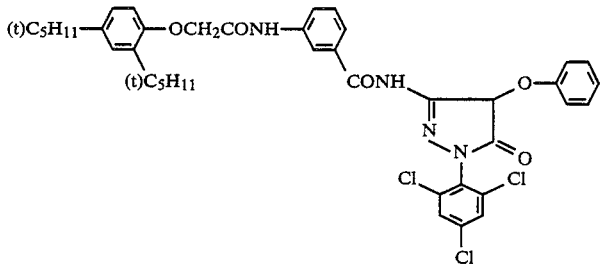
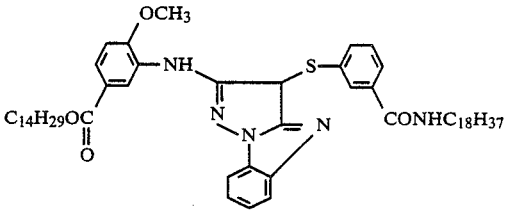
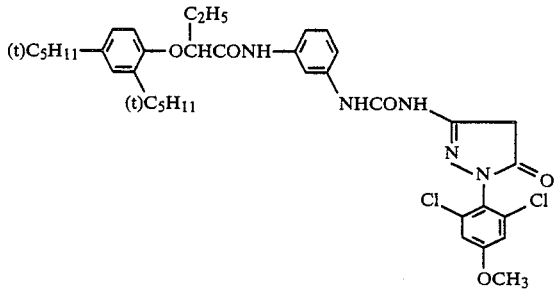
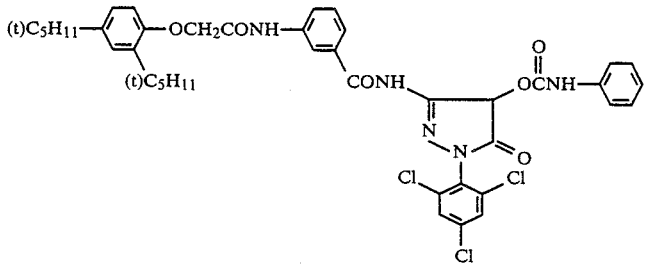

-continued
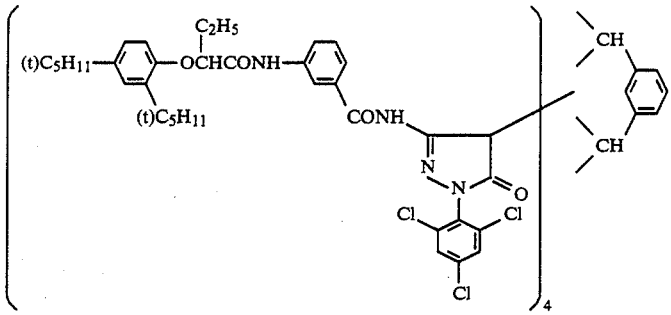
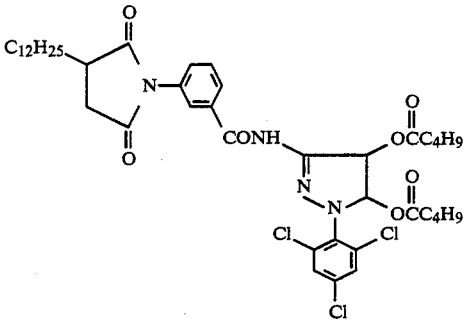
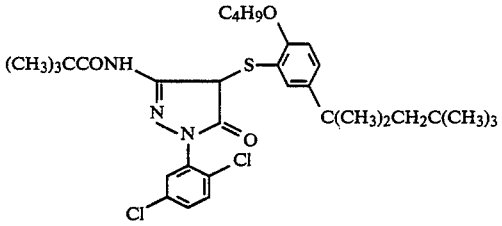
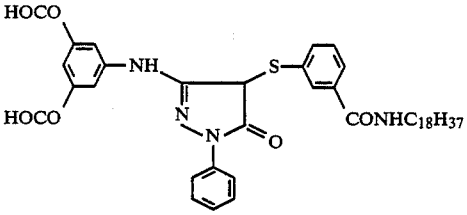
Yellow Color-Forming Couplers
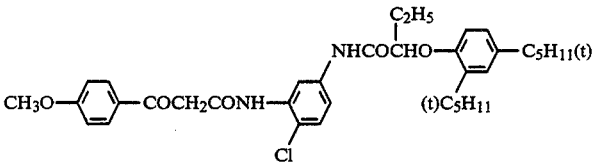
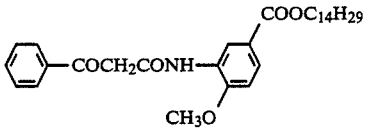
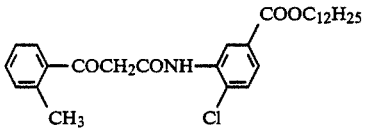
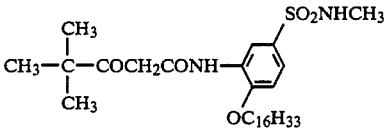

-continued
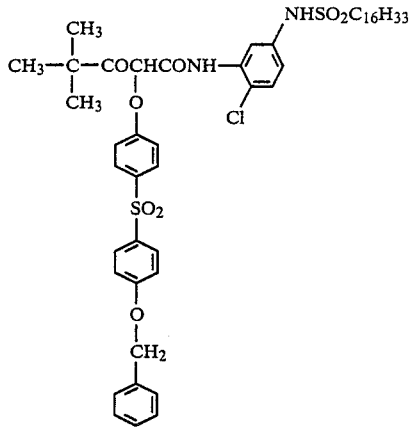
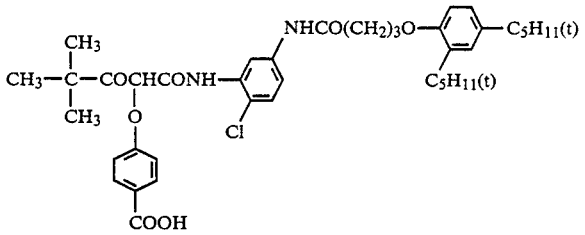
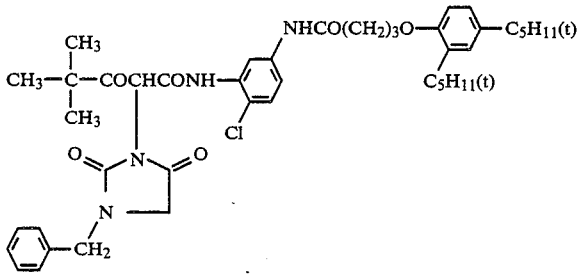
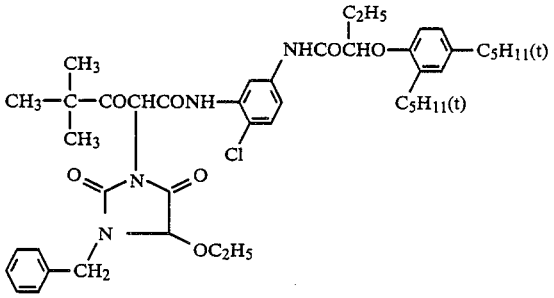
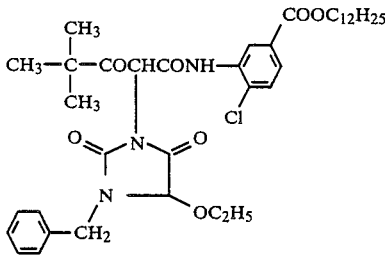
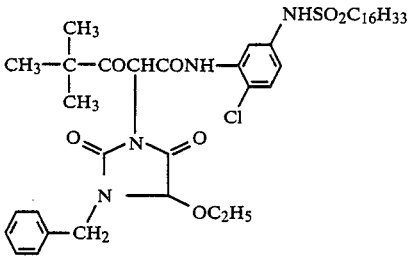
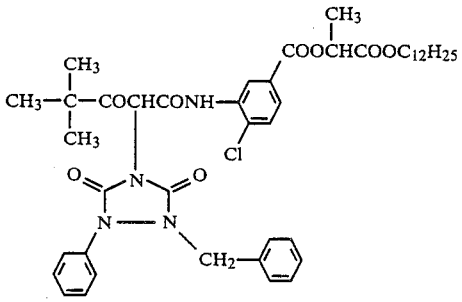
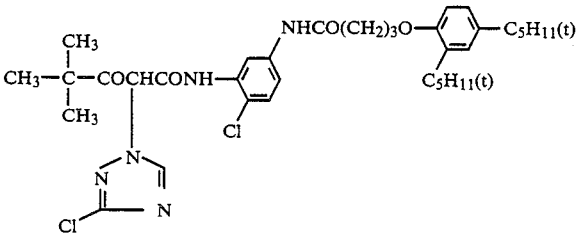

-continued
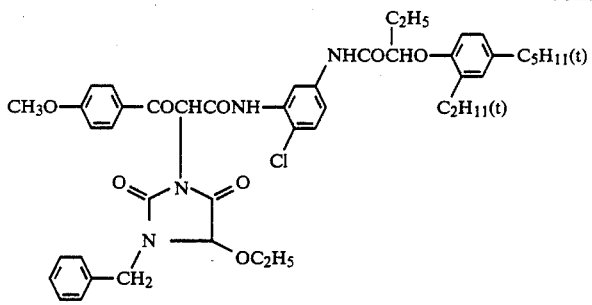
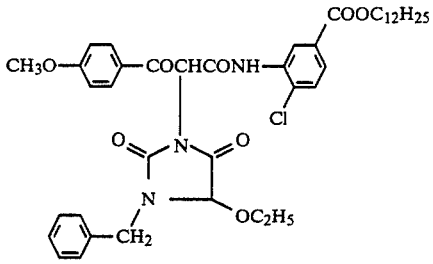
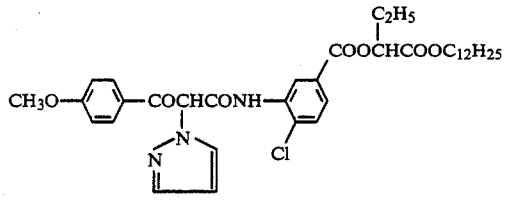
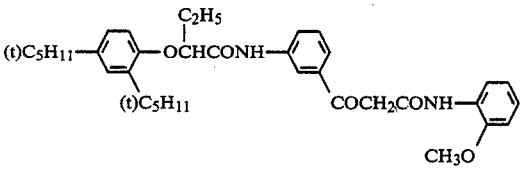
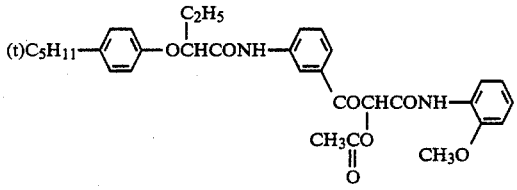
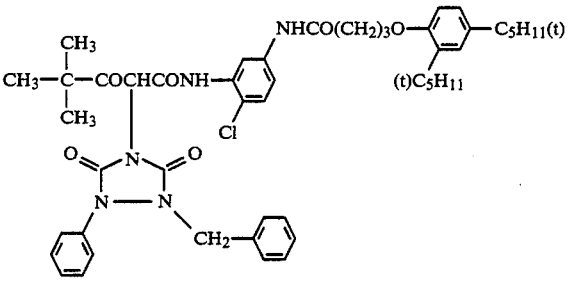
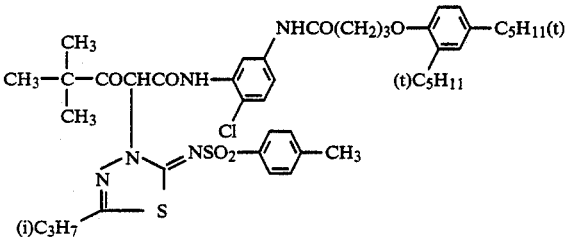
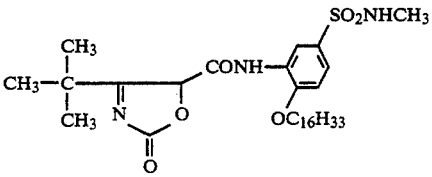
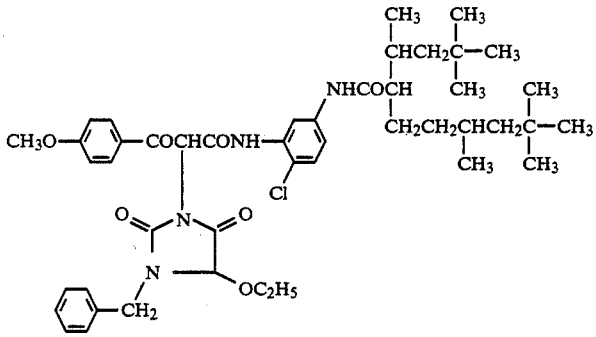
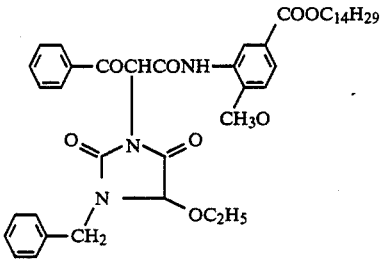

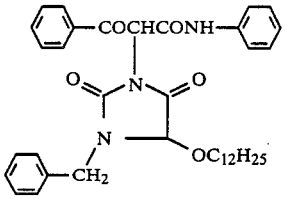
-continued
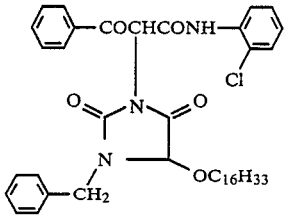
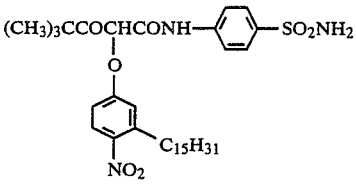
Cyan Color-Forming Couplers
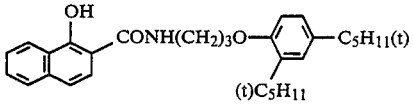
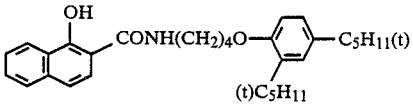
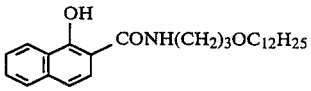
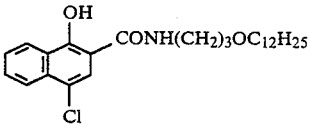
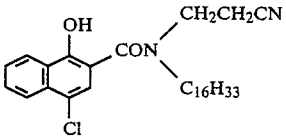
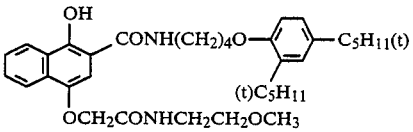
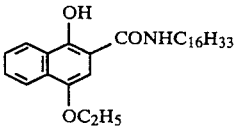
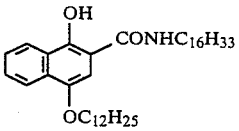
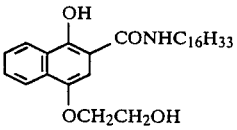
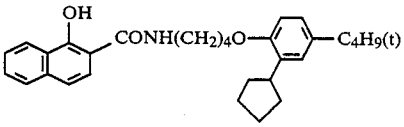
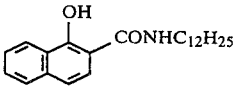
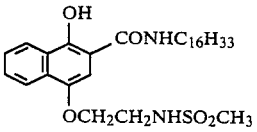

-continued
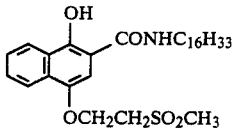
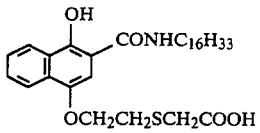
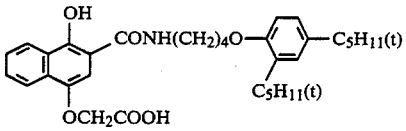
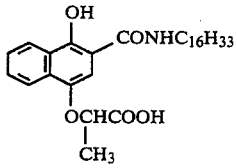
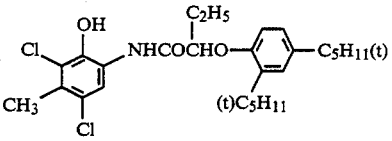
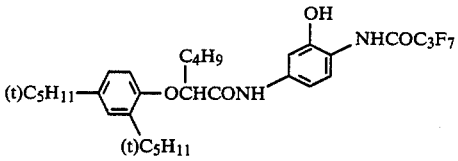
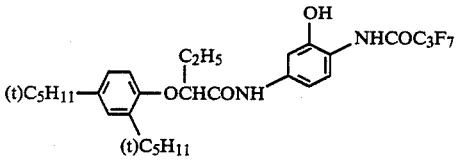
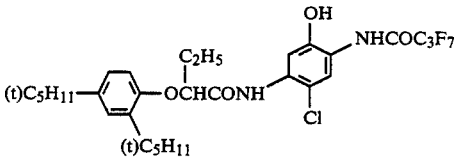
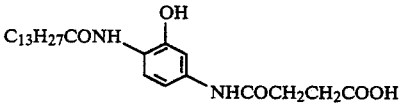
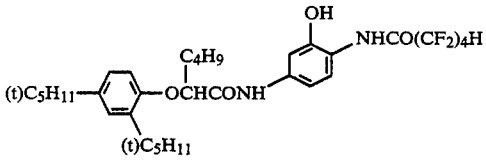
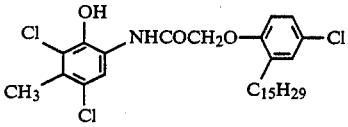
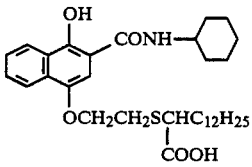
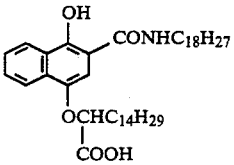
DIR Couplers -continued
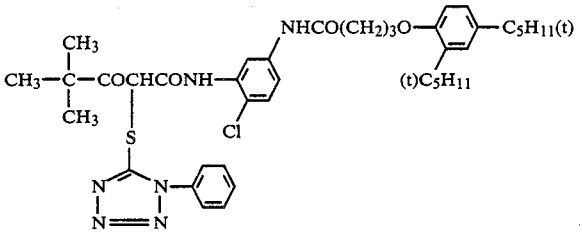
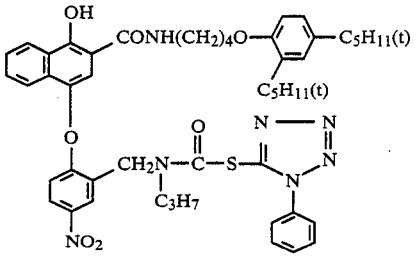
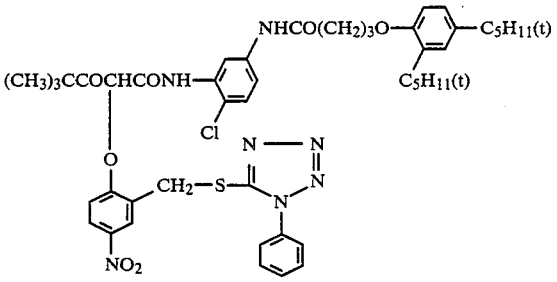
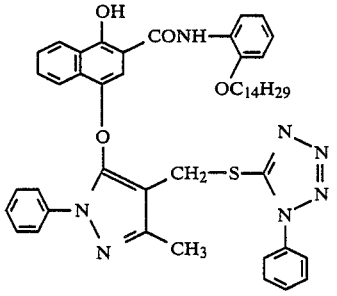
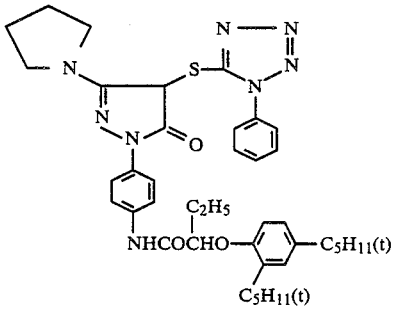
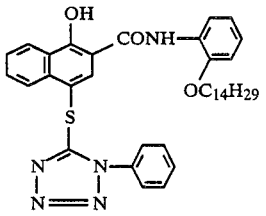
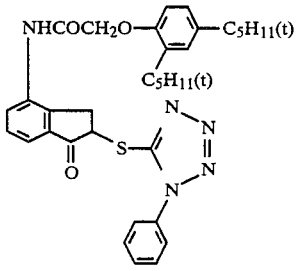
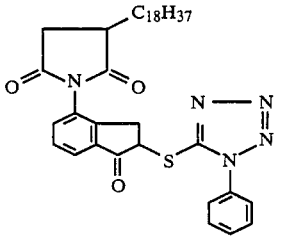
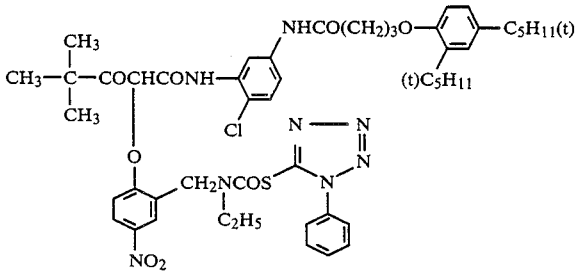
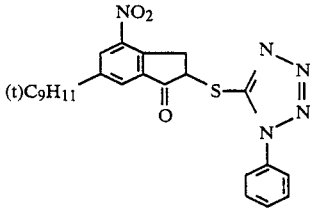

-continued
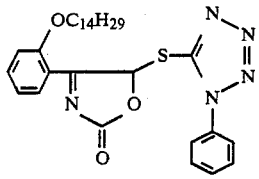
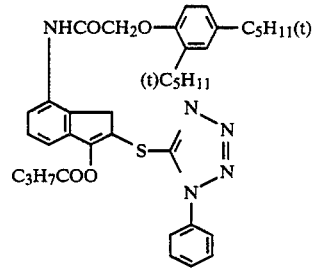
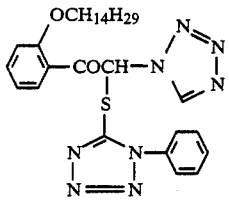
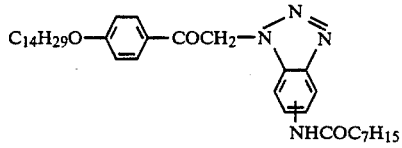
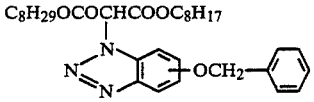
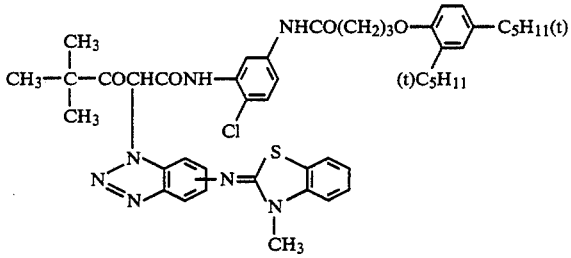
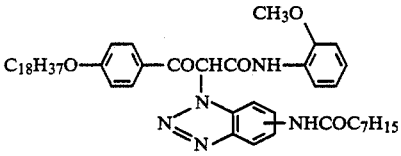
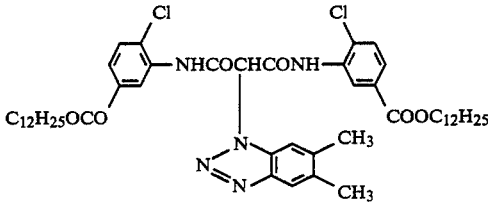
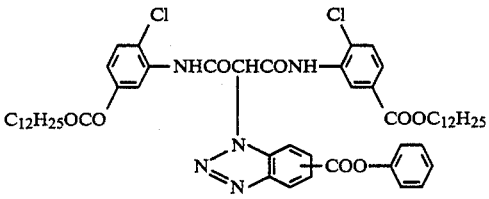
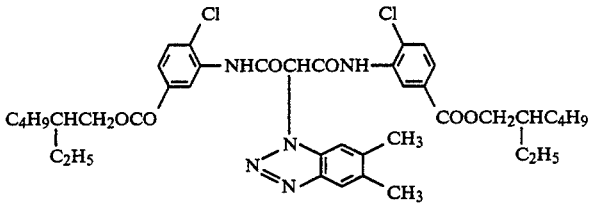
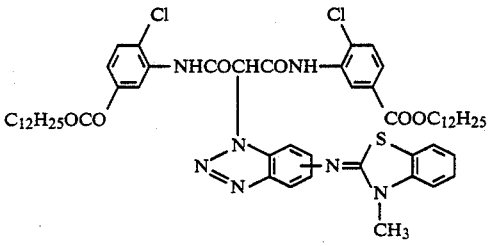
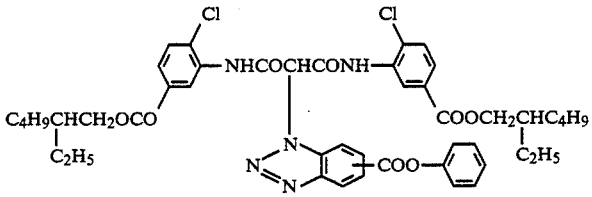

-continued

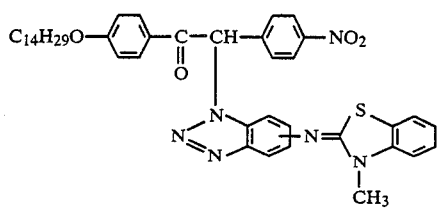

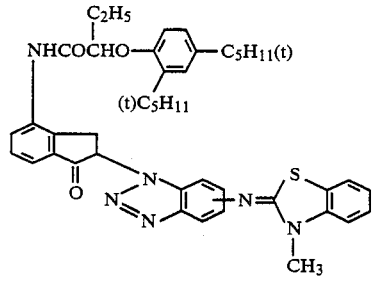

Black Color-Forming Couplers

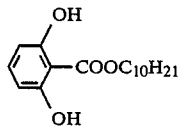

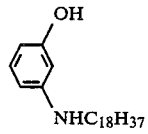

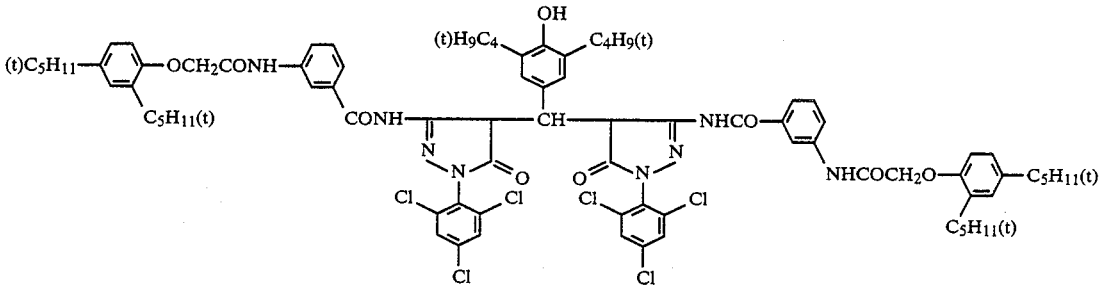

The couplers according to the present invention can be incorporated into silver halide emulsion layers by known methods, including those described, e.g., in U.S. Pat. No. 2,322,027. For example, the couplers can be dissolved into a solvent and then dispersed into a hydrophilic colloid. Examples of solvents usable for this process include high boiling solvents, such as alkyl esters of phthalic acid (e.g., dibutyl phthalate, dioctyl phthalate, dicyclohexyl phthalate, etc.), phosphates (e.g., diphenyl phosphate, triphenyl phosphate, tricresyl phosphate, dioctyl butyl phosphate, trioctyl phosphate, trihexyl phosphate, tricyclohexyl phosphate, etc.), citrates (e.g., tributyl acetyl citrate, etc.), benzoates (e.g., octyl benzoate, etc.), alkylamides (e.g., diethyl laurylamides, etc.), esters of fatty acids (e.g., dibutoxyethyl succinate, dioctyl azeate, etc.) and trimesates (e.g., tributyl trimesate, etc.); and low boiling solvents having a boiling point of from about 30° to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, or the like. Mixtures of these high and low boiling solvents can also be used.

It is also possible to utilize the dispersing method using polymers, as described in Japanese Patent Publication No. 39853/76 and Japanese Patent Application (OPI) No. 59943/76.

Of the couplers according to the present invention, those having an acidic group, such as carboxyl or sulfoxyl, can be introduced into hydrophilic colloids as an aqueous alkalien solution.

In the photographic light-sensitive materials of the present invention, photographic emulsion layers and other layers can be coated on any support conventionally used for photographic materials, including flexible supports, such as ordinary plastic films, paper and cloth, and a rigid support, such as glass, ceramics and metals. Examples of useful flexible supports include films of synthetic or semi-synthetic polymers, such as nitrocelluloses, cellulose acetates, cellulose acetate butyrates, polystyrenes, polyvinyl chlorides, polyethylene terephthalates and polycarbonates; and papers coated or laminated with baryta layer or a layer of α-polyolefins (e.g., polyethylenes, polypropylenes, ethylene-butene copolymers, etc.). These supports can be colored with dyes or pigments. It is also possible to use a black support for the purpose of light shielding. In general, the surface of these supports can be provided with a subbing layer in order to improve the adhesiveness thereof to photographic emulsion layers and other layers. Before or after the subbing, the surface of such a support may be subjected to a surface treatment, such as corona discharge, irradiation of ultraviolet rays, flame treatment, etc.

The present invention can be applied to multilayer multicolor photographic materials comprising at least two layers having different spectral sensitivities each other. A multilayer natural color photographic material generally comprises a support provided thereon with at least one red-sensitive emulsion layer, at least one green-sensitive emulsion layer and at least one blue-sensitive emulsion layer. The order of these emulsion layers can be selected arbitrarily, depending on necessities. In ordinary cases, a cyan color-forming coupler is contained in a red-sensitive layer, a magenta color-forming coupler in a green-sensitive layer, and a yellow color-forming coupler in a blue-sensitive layer. If necessary, different combinations can be selected.

Upon the preparation of emulsions to be used in the present invention, the removal of soluble salts from the precipitated or physically ripened emulsions can be carried out either by the noodle washing method in which a washing operation is effected on gelified gelatin, or by the flocculation method utilizing inorganic salts, anionic surface active agents, anionic polymers (e.g., polystyrene sulfonate) or gelatin derivatives (e.g., acylated gelatins, carbamoyl-modified gelatins, etc.).

In general, silver halide emulsions are chemically sensitized. Their chemical sensitization can be carried out in accordance with the methods described, for example, by H. Fisher, *Die Grundlagen der Photographischen Prozesse mit Silberhalogeniden,* pp. 675 to 734, Academische Verlagsgesellschaft (1968), including sulfur sensitization methods using compounds capable of reacting with active gelatins and silver (e.g., thiosulfates, thioureas, mercapto compounds, rhodanines, etc.); reduction sensitization methods employing reductive substances (e.g., stannous salts, amines, hydrazine derivatives, formamidinesulfinates, silanes, etc.); noble metal sensitization methods utilizing noble metals of Group VII of the Periodic Table (e.g., Pt, Ir, Pd, etc.); and the like. These sensitizers can be used individually, or two or more of these sensitizers can be used in combination. Detailed descriptions on chemical sensitization can be found in a number of patent specifications. As to sulfur sensitization, for example, see U.S. Pat. Nos. 1,574,944, 2,410,689, 2,278,948, 2,728,668 and 3,365,955, etc. As to reduction sensitization, see U.S. Pat. Nos. 2,983,609, 2,419,978 and 4,054,458, etc. As to noble metal sensitization, see U.S. Pat. Nos. 2,399,083 and 2,448,060, British Pat. No. 618,061, etc.

In the photographic light-sensitive materials of the present invention, gelatin can be used with advantage as a binder or protective colloid. It is, however, also possible to use other hydrophilic colloids. Examples of usable colloids include proteins, such as gelatin derivatives, graft polymers between gelatin and other high molecular compounds, albumin and casein; cellulose derivatives, such as hydroxyethyl celluloses, carboxymethyl celluloses and cellulose sulfates; saccharose derivatives, such as sodium alginate and starch derivatives; and synthetic hydrophilic polymers, such as polyvinyl alcohols, partial acetals of polyvinyl alcohols, poly-N-vinylpyrrolidones, polyacrylates, polyacrylamides, polyvinylimidazoles, polyvinylpyrazoles and copolymers thereof. Examples of usable gelatins include gelatins treated with lime, gelatins treated with acids, gelatins treated with enzymes, such as those described in *Bull. Sci. Photo. Japan,* No. 16, p. 30 (1966), hydrolyzed gelatins and gelatins decomposed by enzymes. Useful gelatin derivatives include those prepared through the reaction of gelatin with such compounds as acid halides, acid anhydrides, isocyanates, bromoacetic acid, alkanesultones, vinylsulfonamides, maleinamides, polyalkylene oxides and epoxides. Specific examples of such gelatin derivatives are described, for example, in U.S. Pat. Nos. 2,614,928, 3,132,945, 3,186,846 and 3,312,553, British Pat. Nos. 861,414, 1,033,189 and 1,005,784, and Japanese Patent Publication No. 26845/67.

Examples of usable gelatin graft polymers include those produced by the grafting of gelatin with homo- or copolymers of vinyl monomers, such as acrylic acid, methacrylic acid, derivatives of acrylic or methacrylic acid (e.g., esters, amides, etc.), acrylonitriles and styrene. In particular, graft polymers of gelatin and a polymer compatible, at least partially, with gelatin and produced from such monomers as acrylic acid, methacrylic acid, acrylamide, methacrylamide and hydroxyalkyl methacrylates can be preferable. Examples of such graft polymers are described, e.g., in U.S. Pat. Nos. 2,763,625, 2,831,767 and 2,956,884.

Typical examples of synthetic hydrophilic polymers which can be used in the present invention include those described in German Patent Application (OLS) No. 2,312,708, U.S. Pat. Nos. 3,620,751 and 3,879,205, Japanese Patent Publication No. 7541/68, etc.

The photographic emulsion layers and other hydrophilic layers of the photographic light-sensitive materials of the present invention can be incorporated with a dispersion of water-insoluble or hardly soluble synthetic polymers, in order to improve dimensional stability thereof. Examples of such dispersions include homo- or copolymers of alkyl acrylates or methacrylates, alkoxyalkyl acrylates or methacrylates, glycidyl acrylate or methacrylate, acrylamide or methacrylamide, vinyl esters (e.g., vinyl acetate), acrylonitrile, olefins or styrenes; and copolymers of these monomers with other monomers, such as acrylic acid, methacrylic acid, $\alpha,\beta$-unsaturated dicarboxylic acids, hydroxyalkyl acrylates or methacrylates, sulfoalkyl acrylates or methacrylates and styrenesulfonic acid, including those described, for example, in U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373.

In the light-sensitive materials of the present invention, hydrophilic layers can be incorporated with dyes and UV absorbers. In such cases, the hydrophilic layers can be mordanted, e.g., with cationic polymers, such as those described in British Pat. No. 685,475, U.S. Pat. Nos. 2,675,316, 2,839,401, 2,882,156, 3,048,487, 3,184,309 and 3,445,231, German Patent Application (OLS) No. 1,914,362, and Japanese Patent Application (OPI) Nos. 47624/75 and 71322/75.

The photographic emulsion layers and other hydrophilic layers in the photographic light-sensitive materials of the present invention can be hardened with inorganic or organic hardening agents. Examples of usable hardening agents include chromium salts, such as chromium alum and chromium acetate; aldehydes, such as formaldehyde, glyoxal and glutaraldehyde; N-methylol compounds, such as dimethylolurea and methyloldimethylhydantoin; dioxane derivatives, such as 2,3-dihydroxydioxane; active vinyl compounds, such as 1,3,5-triacryloyl-hexahydro-s-triazine, 1,3-vinylsulfonyl-2-propanol and 1,2-di(vinylsulfonylacetamido)ethanol; active halogen compounds, such as 2,4-dichloro-6-hydroxy-s-triazine; mucohalogenic acids, such as mucochloric acid and mucophenoxychloric acid; etc. These hardening agents can be used individually, or two or more of these hardening agents can be used together.

The photographic emulsion layers and other hydrophilic colloid layers of the light-sensitive materials of the present invention can be incorporated with various surface active agents, in order to improve various properties, such as coating, antistatic, slip-page, emulsifying, dispersing and antiadhesion properties; as well as to obtain improved photographic properties (e.g., accelerated development, increased gradient and sensitivities, etc.). Examples of usable surface active agents include nonionic surfactants, such as steroids (e.g., saponin, etc.), alkylene oxides (e.g., polyethylene glycol, condensation products of polyethylene glycol and polypropylene glycol, polyethylene glycol alkyl ethers, polyethylene glycol alkylaryl ethers, polyethylene glycol esters, polyethylene glycol sorbitan esters, polyalkylene glycol alkylamines or alkylamides, condensation products of silicone and polyethylene oxides, etc.), glycidol derivatives (e.g., polyglycerides of alkenylsuccinic acids, polyglycerides of alkylphenols, etc.), fatty esters of polyalcohols and alkyl esters of succharides; anionic surfactants containing acidic groups (e.g., carboxyl, sulfoxyl, phospho, sulfate, phosphate, etc.), such as alkylcarboxylates, alkylsulfoxylates, alkylbenzenesulfonates, alkylnaphthalenesulfonates, alkylsulfonates, alkylphosphates, N-acyl-N-alkyltaurines, sulfosuccinates, sulfoalkylpolyoxyethylene alkylphenyl ethers and polyoxyethylene alkyl phosphates; amphoteric surfactants, such as amino acids, alkyl sulfonates, aminoalkyl sulfonates or phosphates, alkylbetaines and amine oxides; and cationic surfactants, such as salts of alkylamines, fatty or aromatic quaternary ammonium salts (e.g., pyridiniums, imidazoliums, etc.), and phosphoniums of sulfoniums containing fatty or heterocyclic groups. Fluorine-containing surface active agents can be used, as well.

In the photographic light-sensitive materials of the present invention, any silver halide can be used in photographic emulsion layers thereof, including silver bromide, silver iodobromide, silver iodochlorobromide, silver chlorobromide and silver chloride. Silver iodobromide is preferable.

The photographic emulsions used in the light-sensitive materials of the present invention can be spectrally sensitized by methine dyes or the like. Such sensitizing dyes can be used either alone or in combination. Combinations of sensitizing dyes can be used for the purpose of supersensitization. The photographic emulsions can also contain a sensitizing dye in combination with a dye which per se exerts no sensitizing effect or in combination with a compound which exhibits no substantial absorptions in the visible region of the spectrum, to attain supersensitizing effect. Examples of useful sensitizing dyes and combinations of supersensitizing dyes are described, for example, in *Research Disclosure,* Vol. 176, No. 17643, IV-J, p. 23, published on December, 1978.

The hydrophilic colloid layers in the light-sensitive materials of the invention can be incorporated with water-soluble dyes for the purpose of preventing irradiation or for other purposes. Examples of such dyes include oxonol, hemioxonol, styryl, merocyanine, cyanine and azo dyes. Of these dyes, oxonols, hemioxonols, and merocyanines can be particularly useful.

The photographic emulsion layers of the photographic light-sensitive materials of the invention can be additionally incorporated with such compounds as polyalkylene oxides or derivatives thereof (e.g., ethers, esters, amines, etc.), thioethers, thiomorpholines, quaternary ammonium compounds, urethane derivatives, urea derivatives, imidazole derivatives and 3-pyrazolidones, in order to improve sensitivity and gradient, or to accelerate development thereof. Examples of such compounds include those described in U.S. Pat. Nos. 2,400,532, 2,423,549, 2,716,062, 3,617,280, 3,772,021 and 3,808,003, British Pat. No. 1,488,991, etc.

The photographic emulsions used in the present invention can be additionally incorporated with various additives, for the purpose of stabilizing photographic properties or preventing fogs during production, storage or photographic processing thereof. Examples of usable anti-foggants or stabilizers include azoles, such as benzothiazoliums, nitroindazoles, triazoles, benzotriazoles and benzimidazoles (in particular, nitro- or halogen-substituted benzimidazoles); heterocyclic mercapto compounds, such as mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyrimidines; heterocyclic mercapto compounds as described above containing such water-solubilizing groups as carboxyl and sulfo groups; thioketo compounds, such as oxazolinethiones; azaindenes, such as tetraazaindenes (in particular, 4-hydroxy-substituted-(1,3,3a,7)tetraazaindenes); benzenethiosulfonic acids; benzenesulfinic acids; and the like.

In order to prevent color fogs, the light-sensitive materials of the present invention can be incorporated with such compounds as hydroquinone derivatives, aminophenol derivatives, gallic acid derivatives and ascorbic acid derivatives.

In the practice of the present invention, there can be additionally used known anti-discoloring agents or color image stabilizers, including hydroquinone derivatives, gallic acid derivatives, p-alkoxyphenols, p-oxyphenol derivatives, bisphenols, and the like. These additives can be used individually, or two or more of these additives can be used in combination. Examples of usable hydroquinone derivatives are described, for example, in U.S. Pat. Nos. 2,360,290, 2,418,613, 2,675,314, 2,701,197, 2,704,713, 2,728,659, 2,732,300, 2,735,765, 2,701,801 and 2,816,028, and British Pat. No. 1,363,921. Examples of useful gallic acid derivatives are described, for example, in U.S. Pat. Nos. 3,457,079 and 3,069,262. Examples of useful p-alkoxyphenol derivatives are described, for example, in U.S. Pat. Nos. 2,735,765 and 3,698,909, and Japanese Patent Publication No. 20977/74. Examples of usable p-oxyphenols are described, for example, in U.S. Pat. Nos. 3,432,300, 3,575,050, 3,574,627 and 3,764,337, and Japanese Patent Application (OPI) Nos. 35633/77, 147434/77 and 152225/77. Usable bisphenols are disclosed, for example, in U.S. Pat. No. 3,700,455.

In order to stabilize images, the photographic light-sensitive materials of the present invention can be incorporated in the emulsion layers or adjacent layers thereof with ultraviolet absorbers as described, for example, in U.S. Pat. Nos. 3,250,617 and 3,253,921.

The present invention can be applied to a color photographic light-sensitive material comprising silver halide emulsions having a low silver content, e.g., ½ to 1/100 that of ordinary emulsions. In order to obtain satisfactorily dense color images, such a photographic light-sensitive material can be subjected to a color intensification using peroxides, cobalt complexes, sodium hypochlorite, etc., which enables to enhance the amount of dyes formed therefrom, as described, e.g., in German Patent Application (OLS) No. 2,357,694, U.S. Pat. Nos. 3,674,490 and 3,761,265, German Patent Application (OLS) Nos. 2,044,833, 2,056,359, 2,056,360 and 2,226,770, and Japanese Patent Application (OPI) Nos. 9728/73 and 9729/73.

The photographic light-sensitive materials of the present invention can be subjected to color development in accordance with known methods, including a negative-positive process in which a substituted p-phenylenediamine color developing agent is used to form a dye image and a silver image and the latter is converted into silver salts in a bleach bath, followed by the treatment in a fixing bath to remove all the remaining silver salts, thus leaving the dye image alone; and a color reversal process where a negative silver image is first formed by use of a developing solution containing a black-and-white developer and the remaining silver halides are then subjected to a fogging treatment utilizing, e.g., one or more uniform exposures, followed by color developing, bleaching and fixing treatments to form a positive dye image.

The processing of X-ray films which utilize both silver image and dye image as mentioned above can be carried out in accordance with known color development and fixing treatments. No bleach treatments are required in this case.

These photographic treatments are usually carried out at a temperature of from 18° to 50° C. It is, however, possible to conduct such treatments at a temperature exceeding 50° C. or not exceeding 18° C.

The development of the photographic light-sensitive materials of the present invention can be carried out by use of known p-phenylenediamine derivatives. Among particularly useful p-phenylenediamine color developing agents are included N,N-dialkyl-p-phenylenediamines which may contain substitutional groups in the alkyl and phenyl groups. Specific examples of particularly useful color developing agents include N,N-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)toluene, N-ethyl-N-(β-methanesulfonamidoethyl)-3-methyl-4-aminoaniline hydrochloride, N-ethyl-N-β-hydroxyethylaminoaniline, 4-amino-N-(2-methoxyethyl)-N-ethyl-3-methylaniline-p-toluenesulfonate, N,N-diethyl-3-methyl-4-aminoaniline, N-ethyl-N-(β-hydroxyethyl)-3-methyl-4-aminoaniline, and the like.

Other examples of useful color developers include those described by L. F. A. Mason, *Photographic Processing Chemistry,* pp. 226–229, Focal Press (1966), U.S. Pat. Nos. 2,193,015 and 2,592,364, and Japanese Patent Application (OPI) No. 64933/73.

Color developing solutions to be used for the development of light-sensitive materials according to the present invention can also contain pH buffers, development inhibitors, anti-fogging agents, etc. They can be additionally incorporated, if necessary, with water softeners, preservatives, organic solvents, color-forming couplers, competitive couplers, fogging agents, auxiliary developers, thickeners, chelating agents of polycarboxylate series, antioxidants, and the like.

The bleaching treatment can be effected simultaneously with or separately from the fixing treatment. Useful bleaching agents include compounds of polyvalent metals, such as iron (III), cobalt (III), chromium (VI) and copper (II), peroxides, quinones, nitroso compounds, and the like. Examples of useful bleaching agents include ferricyanides, bichromates, organic complexes of iron (III) or cobalt (III), complexes of aminopolycarboxylic acids, such as ethylenediaminetetraacetic acid, nitrilotriacetic acid and 1,3-diamino-2-propanoltetraacetic acid, complexes of organic acids, such as citric acid, tartaric acid and malic acid, persulfates, permanganates, nitrosophenols, and the like. Of these bleaching agents, potassium ferricyanide, iron (III) sodium ethylenediaminetetraacetate and iron (III) ammonium ethylenediaminetetraacetate can be particularly useful. Ethylenediaminetetraacetic acid iron (III) complex can be useful both in a separate bleaching solution and in a combined bleaching and fixing solution.

Bleaching or bleach-fixing solutions to be used for the processing of photographic light-sensitive materials according to the invention can be additionally incorporated with various additives including bleaching accelerators, such as those described, e.g., in U.S. Pat. Nos. 3,042,520 and 3,241,966, and Japanese Patent Publication Nos. 8506/70 and 8836/70; and thiol compounds such as those described, e.g., in Japanese Patent Application (OPI) No. 65732/78.

Useful examples of fixing agents for the processing of photographic light-sensitive materials according to the invention include thiosulfates (e.g., ammonium thiosulfate, sodium thiosulfate, potassium thiosulfate, etc.), thiocyanates (e.g., ammonium thiocyanate, sodium thiocyanate, potassium thiocyanate, etc.), and thioethers, such as 3,6-dithia-1,8-octanediol. These fixing agents can be used individually or in combination.

EXAMPLE 1

Into a mixture of 100 ml of dibutyl phthalate and 100 ml of ethyl acetate was dissolved 100 g of cyan coupler: 1-hydroxy-2-[γ-(2,4-di-t-aminophenoxy)butyl]-naphthamide (main coupler). This solution was mixed with 1 kg of aqueous 10% gelatin solution containing 1 g of dodecylbenzenesulfonate, and the resulting mixture was stirred at a high speed to form an emulsion. Thereafter, 350 g of the emulsion was mixed with 1 kg of red-sensitive silver iodobromo emulsion containing 50 g of silver and 60 g of gelatin and having an iodine content of 6 mole%. To this mixture was added 50 ml of aqueous 2% solution of sodium salt of 2-hydroxy-4,6-dichloro-s-triazine (hardening agent) to give Coating Solution (A).

Onto a subbed cellulose acetate support was coated the thus-prepared Coating Solution (A) at a coverage of silver of 2.25 g/m$^2$. On the surface of the emulsion layer was then coated an aqueous 5% gelatin solution to form a protective layer having a dried thickness of 1μ, which is designated as Sample [A].

Coating Solutions (B) to (J) were prepared in the same manner as above, except that 10% by mole (based on the main coupler used) of FR couplers set forth below were used, respectively, in addition to the main coupler used in Coating Solution (A). Samples [B] to [J] were then prepared in the same manner as above, using Coating Solutions (B) to (J), respectively.

| Coating Solution | Coupler Used |
|---|---|
| (B) | (1) |
| (C) | (2) |
| (D) | (4) |
| (E) | (5) |
| (F) | (7) |
| (G) | (9) |
| (H) | (11) |

-continued

| Coating Solution | Coupler Used |
|---|---|
| (I) | (14) |
| (J) | (16) |

Samples [A] to [J] were subjected to a sensitometric exposure with white light and then to the following processing at a temperature of 38° C.

| | |
|---|---|
| 1. Color Development | 3 min 15 sec |
| 2. Bleaching | 6 min 30 sec |
| 3. Washing | 3 min 15 sec |
| 4. Fixing | 6 min 30 sec |
| 5. Washing | 3 min 15 sec |
| 6. Stabilizing | 3 min 15 sec |

The processing solutions used above had the following compositions:

| | |
|---|---|
| Color Development Solution: | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—β-hydroxyethylamino)-2-methylaniline sulfate | 4.5 g |
| Water to make | 1 l |
| Bleaching Solution: | |
| Ammonium bromide | 160.0 g |
| Aqueous ammonia (28%) | 25.0 ml |
| Sodium iron ethylenediaminetetra-acetate | 130 g |
| Glacial acetic acid | 14 g |
| Water to make | 1 l |
| Fixing Solution: | |
| Sodium tetrapolyphosphate | 2.0 g |
| Sodium sulfite | 4.0 g |
| Ammonium thiosulfate (70%) | 175.0 g |
| Sodium bisulfite | 4.6 g |
| Water to make | 1 l |
| Stabilizing Solution: | |
| Formalin | 8.0 g |
| Water to make | 1 l |

The densities of the thus-processed samples were measured with red light. Results obtained are shown below.

| Sample | FR Coupler Used | Fog | Relative Sensitivity | Gamma |
|---|---|---|---|---|
| [A] | — | 0.05 | 100 | 1.1 |
| [B] | (1) | 0.05 | 180 | 1.7 |
| [C] | (2) | 0.05 | 190 | 1.7 |
| [D] | (4) | 0.07 | 270 | 2.2 |
| [E] | (5) | 0.06 | 240 | 1.9 |
| [F] | (7) | 0.05 | 230 | 1.9 |
| [G] | (9) | 0.05 | 200 | 1.8 |
| [H] | (11) | 0.06 | 260 | 2.0 |
| [I] | (14) | 0.05 | 260 | 2.1 |
| [J] | (16) | 0.05 | 190 | 1.8 |

The above results show that Samples [B] to [J], which contain FR couplers according to the present invention, have markedly increased sensitivities and gradients. However, the amount of fog is increased only slightly, compared with Sample [A] used for the purpose of control.

EXAMPLE 2

Into 100 g of dibutyl phthalate and 100 ml of ethyl acetate was dissolved 100 g of magenta coupler: 1-(2,4,6-trichlorophenyl)-3-{3-[2-(2,4-di-t-amylphenoxy)butyramido]benzamido}-5-oxo-2-pyrazolone (main coupler). This solution was mixed with 1 kg of aqueous 10% gelatin solution containing 1 g of sodium dodecylbenzenesulfonate, and the resulting mixture was stirred at a high speed to form an emulsion. Thereafter, 350 g of the emulsion was mixed with 1 kg of green-sensitive iodobromide emulsion containing 50 g of silver and 60 g of gelatin and having an iodine content of 6% by mole. To this mixture was added 50 ml of aqueous 2% solution of sodium salt of 2-hydroxy-4,6-dichloro-s-triazine (hardening agent) to give Coating Solution (K).

Onto a subbed cellulose triacetate support was coated Coating Solution (K) at a coverage of silver of 2.25 g/m$^2$. Thereafter, an aqueous 5% gelatin solution was coated on the emulsion layer to form a protective layer having a dried thickness of 1μ, which is designated as Sample [K].

Coating Solutions (L) to (T) were prepared in the same manner as above, except that 10% by mole (based on the main coupler used) of FR couplers set forth below were used, respectively, in addition to the main coupler used in Coating Solution (K). Samples [L] to [T] were prepared in the same manner as above, using Coating Solutions (L) to (T), respectively.

| Coating Solution | Coupler Used |
|---|---|
| (K) | — |
| (L) | (1) |
| (M) | (3) |
| (N) | (4) |
| (O) | (6) |
| (P) | (8) |
| (Q) | (10) |
| (R) | (12) |
| (S) | (13) |
| (T) | (15) |

The thus-prepared Samples [K] to [T] were subjected to a sensitometric exposure and then to the same processing as in Example 1.

The densities of the processed samples were measured with green light. Results obtained are shown below.

| Sample | FR Coupler Used | Fog | Relative Sensitivity | Gamma |
|---|---|---|---|---|
| [K] | — | 0.06 | 100 | 1.7 |
| [L] | (1) | 0.06 | 160 | 2.7 |
| [M] | (3) | 0.07 | 240 | 3.1 |
| [N] | (4) | 0.07 | 260 | 3.2 |
| [O] | (6) | 0.06 | 180 | 2.8 |
| [P] | (8) | 0.08 | 240 | 3.0 |
| [Q] | (10) | 0.06 | 190 | 2.8 |
| [R] | (12) | 0.06 | 150 | 2.4 |
| [S] | (13) | 0.07 | 220 | 2.9 |
| [T] | (15) | 0.06 | 250 | 3.1 |

It would be seen from the above results that Samples [L] to [T], which contain FR couplers according to the present invention, have markedly increased sensitivities and gradients. However, the amount of fog increased only slightly, compared with Sample [K] used for the purpose of control and containing no FR couplers.

EXAMPLE 3

Samples [K], [L], [N] and [P] prepared in Example 2 were subjected to a stepwise exposure with white light and then to the following processing at a temperature of 38° C.

| | |
|---|---|
| 1. Color Development | 3 min 15 sec |
| 2. Stopping | 30 sec |
| 3. Fixing | 10 min |
| 4. Washing | 5 min |

The processing solutions used above had the following compositions:

COLOR DEVELOPMENT SOLUTION

The same as that used in Example 1.

| | |
|---|---|
| Stopping Solution: | |
| Acetic acid | 15 ml |
| Water to make | 1 l |
| Fixing Solution: | |
| Sodium sulfite | 5 g |
| Sodium thiosulfate | 50 g |
| Water to make | 1 l |

The thus-processed samples were observed under an optical microscope, and the numbers of developed silver particles contained per unit area were compared. Results obtained are shown below. In the table, the ratios of the number of developed silver particles to the number contained in control Sample [K] are shown.

| Sample | FR Coupler Used | Relative Number of Developed Silver Particles | |
|---|---|---|---|
| | | Fog Area | High Density Area |
| [K] | — | 1.0 | 1.0 |
| [L] | (1) | 1.0 | 2.5 |
| [N] | (4) | 1.1 | 4.0 |
| [P] | (8) | 1.2 | 3.5 |

The above results clearly show that the numbers of developed silver particles are markedly increased in high exposure areas, but only slightly in fog areas, based on the use of FR couplers according to the invention.

EXAMPLE 4

Sample [U] was prepared in the same manner as in Sample [N] prepared in Example 2, except that 10% by mole (based on the main coupler used) of 3-(2-hydroxyethyl)-2-thioxo-4-thiazolidine (fogging agent to be released from FR Coupler (4)) was used instead of FR Coupler (4). The chemical structure of the FR coupler and the fogging agent are as follows:

Coupler (4):

-continued

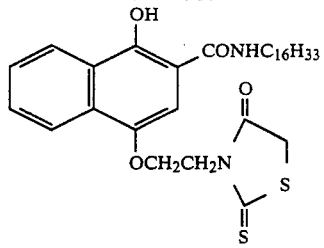

Fogging Agent: 3-(2-hydroxyethyl)-2-thioxo-4-thiazolidinone

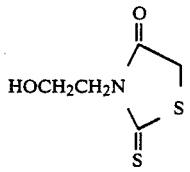

Samples [K], [N] and [U] were exposed and processed in the same manner as in Example 2. The densities of the processed samples were measured with green light. Results obtained are shown below.

| Sample | Coupler and Additive Used | Fog | Maximum Density | Relative Sensitivity | Gamma |
|---|---|---|---|---|---|
| [K] | Main Coupler (magenta coupler) | 0.06 | 2.51 | 100 | 1.7 |
| [N] | Main Coupler (magenta coupler) + Coupler (4) | 0.07 | 2.56 | 260 | 3.2 |
| [U] | Main Coupler (magenta coupler) + 3-(2-hydroxyethyl)-2-thioxo-4-thiazolidinone | 2.48 | 2.54 | — | 0.2 |

The above results clearly show that increased sensitivities and gradients attained by the use of FR couplers according to the present invention are based on an imagewise release of fogging agents during the course of development from FR couplers containing releasable fogging groups.

EXAMPLE 5

Sample [V] was prepared in a similar manner as in Example 2, except that a coupler (which will hereinafter be referred to as Coupler A) described in U.S. Pat. No. 3,253,924 and having the following formula:

Coupler A:

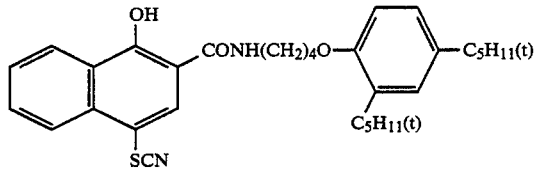

was used in an amount of 10% by mole, based on the amount of main coupler used, instead of the FR couplers used in Example 2. This sample and Samples [K] and [N], prepared in Example 2, were exposed and processed in the same manner as in Example 2 or Example 3. The densities of samples subjected to the processing according to Example 2 were measured with green light. Samples subjected to the processing according to Example 3 were observed under an optical microscope and the number of developed silver particles contained in unit area was counted. Results obtained are shown below. In the following table, the ratios of the number of developed silver particles to the number contained in Control Sample [K] are shown.

| Sample | Coupler Used | Fog | Relative Sensitivity | Gamma | Relative Number of Developed Silver Particles: Fog Area | Relative Number of Developed Silver Particles: High Density Area |
|---|---|---|---|---|---|---|
| [K] | — | 0.06 | 100 | 1.7 | 1.0 | 1.0 |
| [N] | Coupler (4) | 0.07 | 260 | 3.2 | 1.1 | 4.0 |
| [V] | Coupler A | 0.06 | 103 | 1.75 | 10 | 1.0 |

The above results indicate that Sample [V], which contains Coupler A (or a coupler capable of releasing a development accelerator based on the physical dissolution development effect described in the above-described U.S. Patent), has little development acceleration effect and shows substantially no increase in the number of developed silver particles. It would, therefore, be apparent that the function of the FR couplers according to the present invention is quite different from that of Coupler A.

EXAMPLE 6

Samples [W], [X], [Y] and [Z], color negative films having the following layer structure, were prepared.

| | | |
|---|---|---|
| Protective Gelatin Layer | | |
| UV-Absorbing Layer | | |
| High Speed Blue-Sensitive Emulsion Layer Containing: | | |
| Silver halide | 1.30 g/m$^2$ | |
| Gelatin | 0.80 g/m$^2$ | |
| Yellow coupler | 0.15 g/m$^2$ | |
| FR coupler | Sample [W]: | 0 mole % |
| | Sample [X]: | 10 mole % based on the yellow coupler |
| | Sample [Y]: | 10 mole % based on the yellow coupler |
| | Sample [Z]: | 10 mole % based on the yellow coupler |
| Low Speed Blue-Sensitive Emulsion Layer Containing: | | |
| Silver halide | 1.90 g/m$^2$ | |
| Gelatin | 2.50 g/m$^2$ | |
| Yellow coupler | 1.50 g/m$^2$ | |
| DIR coupler | 0.05 g/m$^2$ | |
| Yellow Filter Layer | | |
| High and Low Speed Green-Sensitive Emulsion Layers | | |
| Interlayer | | |
| High and Low Speed Red-Sensitive Emulsion Layers | | |
| Antihalation Layer | | |
| Cellulose Acetate Base | | |

In preparing the above sample, couplers were dispersed into a mixture of organic solvents containing a coupler solvent, emulsified, and then introduced into the photographic emulsions. The yellow coupler and the DIR coupler used above had the following formulae:

Yellow Coupler:

-continued

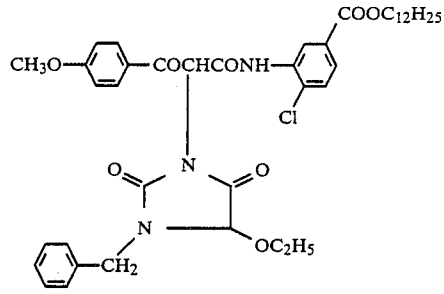

DIR Coupler:

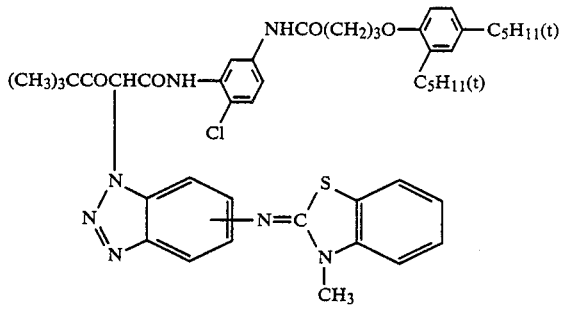

Sample [W] having the above described layer structure was prepared, whereby no FR coupler was incorporated. However, Samples [X], [Y] and [Z] having the same layer structure as above were prepared, whereby FR Couplers (4), (5) or (6), respectively, were additionally incorporated into the high speed blue-sensitive layer at a ratio of 10% by mole based on the yellow coupler used.

Samples [W], [X], [Y] and [Z] were subjected to a sensitometric exposure with white light and then to the same processing as in Example 1. The densities of processed samples were measured with blue light. Relative sensitivities obtained are shown below.

| Sample | Relative Sensitivity |
|---|---|
| [W] | 100 |
| [X] | 240 |
| [Y] | 195 |
| [Z] | 165 |

The results clearly show that the samples in which the FR couplers according to the present invention are used have increased sensitivities.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material, comprising:

a support having positioned thereon:

a light-sensitive silver halide emulsion layer; and a compound represented by the general formula (I):

A-B (I)

wherein A is a residue of a compound capable of undergoing a coupling reaction with an oxidized primary amine developer, the residue being derived by eliminating a hydrogen atom from an active position of the compound; and B is a group capable of being released through a coupling reaction to exert a fogging effect wherein B is a residue of a thiocarbonyl selected from the group consisting of thioureas, thioamides, thiocarbamates, dithiocarbamates, rhodanines and thiohydantoins or is a residue of a compound containing a functional group or moiety selected from hydrazines, hydrazones, polyamines, enamines, acetylenes, quaternary salts and aldehydes.

2. A silver halide photographic light-sensitive material as claimed in claim 1, wherein the residue is a residue of a cyan color-forming coupler selected from the group consisting of phenols and naphthols.

3. A silver halide photographic light-sensitive material as claimed in claim 1, wherein the residue is a residue of a magenta color-forming coupler selected from the group consisting of 5-pyrazolones, pyrazolobenzimidazoles, cyanoacetylcoumarones, open chain acylacetonitriles and indazolones.

4. A silver halide photographic light-sensitive material as claimed in claim 1, wherein the residue is a residue of yellow color-forming coupler selected from the group consisting of acylacetamides, dibenzoylmethanes and malondianilides.

5. A silver halide photographic light-sensitive material as claimed in claim 1, wherein the residue is a residue of a non-color-forming coupler.

6. A silver halide photographic light-sensitive material as claimed in claim 1, wherein the B is a residue of a thiocarbonyl selected from the group consisting of thioureas, thioamides, thiocarbamates, dithiocarbamates, rhodanines and thiohydantoins.

7. A silver halide photographic light-sensitive material as claimed in claim 1, wherein the B is a residue of a compound containing a functional group or moiety selected from hydrazines, hydrazones, polyamines, enamines, acetylenes, quaternary salts and aldehydes.

8. A silver halide photograhic light-sensitive material as claimed in claim 1, wherein the compound of general formula (I) is present in an amount in the range of $2\times10^{-3}$ to $5\times10^{-1}$ mole per mole of silver.

9. A silver halide photographic light-sensitive material as claimed in claim 8, wherein the compound of general formula (I) is present in an amount in the range of $1\times10^{-2}$ to $5\times10^{-1}$ mole per mole of silver.

10. A silver halide photographic light-sensitive material as claimed in claim 9, wherein the compound of general formula (I) is 0.001 to 100% by mole of the total amount of couplers present in the material.

11. A silver halide photographic light-sensitive material as claimed in claim 10, wherein the compound of general formula (I) is 0.1 to 10% by mole of the total amount of couplers present in the material.

* * * * *